US011753761B2

(12) United States Patent
Lee et al.

(10) Patent No.: US 11,753,761 B2
(45) Date of Patent: Sep. 12, 2023

(54) WASHING MACHINE AND CONTROL METHOD THEREOF

(71) Applicant: LG Electronics Inc., Seoul (KR)

(72) Inventors: Jeonguk Lee, Seoul (KR); Manho Chun, Seoul (KR); Sechang Kim, Seoul (KR); Joonho Pyo, Seoul (KR); Taehyeon Sim, Seoul (KR)

(73) Assignee: LG Electronics Inc., Seoul (KR)

( * ) Notice: Subject to any disclaimer, the term of this patent is extended or adjusted under 35 U.S.C. 154(b) by 267 days.

(21) Appl. No.: 17/091,711

(22) Filed: Nov. 6, 2020

(65) Prior Publication Data

US 2021/0131013 A1 May 6, 2021

(30) Foreign Application Priority Data

Nov. 6, 2019 (KR) ..... 10-2019-0140937

(51) Int. Cl.

| | |
|---|---|
| ***D06F 37/40*** | (2006.01) |
| ***D06F 37/24*** | (2006.01) |
| ***D06F 37/30*** | (2020.01) |
| ***D06F 23/04*** | (2006.01) |

(52) U.S. Cl.

CPC ..... *D06F 37/40* (2013.01); *D06F 37/24* (2013.01); *D06F 37/304* (2013.01); *D06F 23/04* (2013.01)

(58) Field of Classification Search

CPC ..... D06F 23/04; D06F 37/24; D06F 37/304; D06F 37/40

See application file for complete search history.

(56) References Cited

U.S. PATENT DOCUMENTS 6,148,646 A * 11/2000 Koshiga ..... D06F 37/40 68/23.7
6,332,343 B1 * 12/2001 Koketsu ..... D06F 37/304 68/12.02
7,089,769 B2 * 8/2006 Lim ..... D06F 37/40 68/133

(Continued)

FOREIGN PATENT DOCUMENTS

KR 1020030007054 1/2003
KR 1020030023316 3/2003

(Continued)

OTHER PUBLICATIONS

Machine translation of KR 101892012 B1. (Year: 2018).*
Office Action in Australian Appln. No. 2020264413, dated Jun. 30, 2021, 11 pages.

*Primary Examiner* — Joseph L. Perrin
(74) *Attorney, Agent, or Firm* — Fish & Richardson P.C.

(57) ABSTRACT

A washing machine and a control method therefor are provided. The washing machine includes a water tank, a washing tub, a pulsator, a drive motor, a coupling flange connected to the drive motor, a drive shaft that rotates the pulsator, a dewatering shaft that rotates the washing tub, a coupler configured to move up and down along the dewatering shaft and to be placed in a first position where the coupler engages the coupling flange and in a second position where the coupler is placed above the coupling flange, a solenoid module that moves the coupler, a coupler guide configured to be rotated by the coupler and fix the coupler in the second position, and a controller configured to control the solenoid module to move the coupler.

9 Claims, 24 Drawing Sheets

(56) References Cited

U.S. PATENT DOCUMENTS

| | | | | |
|---|---|---|---|---|
| 7,454,929 | B2 * | 11/2008 | Cho | D06F 37/40 68/133 |
| 7,621,158 | B2 * | 11/2009 | Roepke | D06F 37/40 192/69.7 |
| 7,841,218 | B2 * | 11/2010 | Dominguez | D06F 37/40 68/133 |
| 9,157,176 | B2 * | 10/2015 | Lee | D06F 37/40 |

FOREIGN PATENT DOCUMENTS

| | | |
|---|---|---|
| KR | 1020160035877 | 4/2016 |
| KR | 101892012 | 8/2018 |
| WO | WO2020138992 | 7/2020 |

* cited by examiner

WASHING MACHINE AND CONTROL METHOD THEREOF

CROSS-REFERENCE TO RELATED APPLICATION

This application claims the benefit of priority to Korean Application No. 10-2019-0140937, filed on Nov. 6, 2019, the disclosure of which is incorporated by reference in its entirety.

TECHNICAL FIELD

The present disclosure relates to a washing machine with a clutch that is operated by a solenoid and a control method thereof.

BACKGROUND

A top-loading washing machine comprises a washing tub and pulsator which spin to agitate laundry or wash water within a water tank. The washing tub spins by the rotation of a dewatering shaft, and the pulsator spins by the rotation of a drive shaft, with the drive shaft and the dewatering shaft having a structure in which they rotate about the same axis of rotation.

Incidentally, a driving force caused by the rotation of a drive motor may be transferred to the drive shaft or dewatering shaft, in order to selectively or simultaneously spin the washing tub and the pulsator depending on the washing method and the washing stroke.

The drive shaft may have a structure in which it is connected to the drive motor and rotate when the drive motor rotates. Also, the dewatering shaft may have a structure in which the torque of the drive motor is transferred or not, depending on the configuration of a coupler.

In Korean Laid-Open Patent No. 10-2001-0002545, a separate motor and link structure for adjusting the configuration of a coupler is included. This link structure, however, may bring about problems of structural complexity and narrow space due to the complicated structure may bring out problems of structural complexity and narrow space due to the complicated structure.

Korean Laid-Open Patent No. 10-2003-0023316 discloses a structure in which the configuration of a coupler is adjusted by operating a solenoid. In this disclosed structure, it is possible to figure out the initial configuration of the coupler by the operation of the solenoid; however, the problem of heat generation from a coil, the problem of power consumption, and the problem of damage to the coupler caused by power disconnection due to abnormal operation may occur because the solenoid requires continuous power application in order to keep the coupler in a higher position to where it is moved.

SUMMARY

A first aspect of the present disclosure is to provide a washing machine capable of adjusting the configuration of a coupler without continuous application of power to a solenoid, in a structure where the configuration of the coupler is adjusted by the operation of a solenoid.

A second aspect of the present disclosure is to provide a washing machine capable of identifying the position of a coupler for selectively driving a dewatering shaft without a sensor, and a control method thereof.

The aspects of the present disclosure are not limited to the above-mentioned aspects, and other aspects that have not been mentioned will be clearly understood to those skilled in the art from the following description.

To accomplish the above aspects, there is provided a washing machine according to the present disclosure, the washing machine comprising: a coupler configured to move in a lengthwise direction of a dewatering shaft and transmit torque from a drive motor to the dewatering shaft when disposed to engage a coupling flange; and a solenoid module that moves the coupler upward in the lengthwise direction of the dewatering shaft. Furthermore, the washing machine may comprise a coupler guide that rotates itself or fixes the position of the coupler, when the coupler moves upward in the lengthwise direction of the dewatering shaft, whereby the coupler may be fixed in position once moved upward.

The coupler may engage the coupling flange when in a first position or may be disposed above the coupler guide when in a second position which is higher than the first position. Also, the solenoid module may allow the coupler in the first or second position to move upward.

The coupler guide may rotate by contact with the coupler when the coupler moves upward, and may fix the coupler in the second position or guide it to the first position when the coupler moves downward.

Specifically, the coupler guider may rotate when the coupler comes into contact with the lower side of the coupler guide while moving upward.

The controller may adjust the operation time of the solenoid module so that the coupler in the first or second position moves to the first position.

The controller may limit the length the coupler moves by the solenoid module so that the coupler is in the first position. It is possible to figure out the position of the coupler since the solenoid module is regulated by the controller. The controller may make the solenoid module operate in such a way that the coupler moves as high as or less than the distance between the first position and the second position.

The controller may make the solenoid module operate so that the coupler in the second position comes into contact with the lower side of the coupler guide, and may make the solenoid module operate in such a way that the coupler in the first position does not come into contact with the lower side of the coupler guide.

The coupler may comprise a guide member that passes through the coupler guide or fixes the coupler in the second position by locking portions that lock onto the upper side of the coupler guide, wherein the guide member is disposed under the coupler guide when the coupler is in the first position, thus keeping the coupler from moving to the second position, even with the operation of the controller.

The coupler guide may comprise: a coupler guide body having the shape of a ring and disposed on the outer perimeter of the dewatering shaft; and a plurality of guide projections disposed on the outer perimeter of the coupler guide body, that rotate the coupler guide body or fix the position of the coupler, when in contact with the coupler.

The controller may make the solenoid module operate in such a way that the coupler moves to where the guide member is in a lower position than the upper ends of the guide projections when the guide member is disposed under the guide projections, thus keeping the coupler from sitting on the upper side of the coupler guide and placing it in the first position.

The guide projections may have locking grooves on the upper surface where the locking portions are fixed, and the locking portions may be disposed on the upper sides of the locking grooves when the coupler is in the second position.

The coupler guide may comprise: a coupler guide body having the shape of a ring and disposed on the outer perimeter of the dewatering shaft; and a plurality of guide projections disposed on the outer perimeter of the coupler guide body, that rotate the coupler guide body or fix the position of the coupler, when in contact with the coupler. The controller may make the solenoid module operate in such a way that the coupler moves higher than the length along which the coupler in the second position moves up the dewatering shaft until the stoppers and the guide projections come into contact with each other, thus allowing the coupler to move from the second position to the first position.

The stoppers may comprise first stoppers having a first sloping surface and second stoppers having the angle of slope as the first sloping surface and being shorter in length than the first sloping surface. The locking portions of the guide member may be disposed above the first stoppers. The length the first stoppers protrude upward may be shorter than the distance between the locking portions and the lower ends of the coupler guide when the coupler is in the first position. The controller may make the solenoid module operate in such a way that the coupler moves less than the distance from the lower ends of the first stoppers to the locking portions, thus keeping the coupler in the first position.

The controller may make the solenoid module operate in such a way that the coupler in the second position moves until the coupler guide rotates by contact between the second stoppers and the guide projections, thus allowing the coupler to move from the second position to the first position.

Moreover, the position of the coupler may be adjusted by adjusting the time for electric current application to the solenoid so that the coupler is moved to the first position, by using the difference between the time taken for the coupler to move from the first position to the second position and the time taken for the coupler to move from the second position to the first position. That is, since the time taken for the coupler to move from the first position to a third position, i.e., the highest position, is shorter than the time taken from the coupler to move from the second position to the third position, the controller may make the solenoid module operate within a time range during which the coupler moves from the second position to the third position, so that the coupler is kept in the first position or moves.

The coupler may comprise a guide member that passes through the coupler guide or fixes the coupler in the second position by locking portions that lock onto the upper side of the coupler guide. The stoppers may comprise: first stoppers that come into contact with the guide projections when the coupler in the first position moves upward; and second stoppers that come into contact with the guide projections when the coupler in the first position move upward. The locking portions of the guide member may be disposed above the first stoppers. The controller may make the solenoid module operate until the second stoppers come into contact with the lower surface of the coupler guide, so that the coupler moves to the first position.

A washing machine according to the present disclosure may comprise: a coupler that axially couples or decouples a dewatering shaft for spinning a washing tub and a drive shaft for spinning a pulsator, depending on the configuration; a solenoid module that moves the coupler upward by applying an electric current to a coil; and a coupler guide that selectively restrains the downward movement of the coupler once moved upward by the solenoid module, wherein the coupler may axially couple the dewatering shaft and the drive shaft when placed in a lower position by the coupler guider.

In this instance, the washing machine may be controlled through a mode resetting step in which the dewatering shaft and the drive shaft are axially coupled, by operating the solenoid module in such a way that the coupler disposed to axially couple or decouple the dewatering shaft and the drive shaft moves under the coupler guide.

Furthermore, the washing machine according to the present disclosure may operate in a first mode in which the coupler axially couples the drive shaft and the dewatering shaft and in a second mode in which the coupler axially decouples the drive shaft and the dewatering shaft. Through the mode resetting step, the washing machine may be controlled to place the coupler in the first mode.

The coupler may change from the first mode to the second mode when the coupler guides rotates by contact with the coupler, and the coupler may change from the second mode to the first mode when the coupler guide rotates by contact with the coupler.

In the mode resetting step, the solenoid module may operate in such a way that the coupler in the first mode does not come into contact with the coupler guide, and the solenoid module may operate in such a way that the coupler in the second mode comes into contact with the coupler guide. Therefore, the coupler may be placed in the first mode.

In the mode resetting step, an electric current may be applied to the coil of the solenoid module so that the coupler moves as high as or less than the distance between the coupler in the first mode and the coupler in the second mode. Therefore, the coupler may be placed in the first mode.

A first mode change step in which the solenoid module operates in such a way that the coupler in the first mode is placed into the second mode may be performed after the mode resetting step, and a second mode change step in which the solenoid module operates in such a way that the coupler in the first mode is placed into the first mode may be performed after the first mode change step. Therefore, the configuration of the coupler may be changed.

When the first mode change step or the second mode change step is performed, the coupler may move to a position where the stoppers and the coupler guide come into contact with each other, thus allowing the coupler guide to rotate.

A first period of time taken for the coupler to move upward in the first mode change step is shorter than a second period of time taken for the coupler to move upward in the second mode change step. That is, the height the coupler may move upward in the first mode change step is greater than the height the coupler may move upward in the second mode change step. Here, in the mode resetting step, the solenoid module is operated for longer than the first period of time and shorter than the first period of time, whereby the coupler may be placed in the first mode.

In the mode resetting step, an electric current may be applied to the coil of the solenoid module to move the coupler upward, so that the coupler in the first mode or second mode moves under the coupler guide along the guide holes formed in the coupler guide. Therefore, the coupler may be placed in the first mode.

Details of other embodiments are included in the detailed description and drawings.

DETAILED DESCRIPTION

Figure 1:
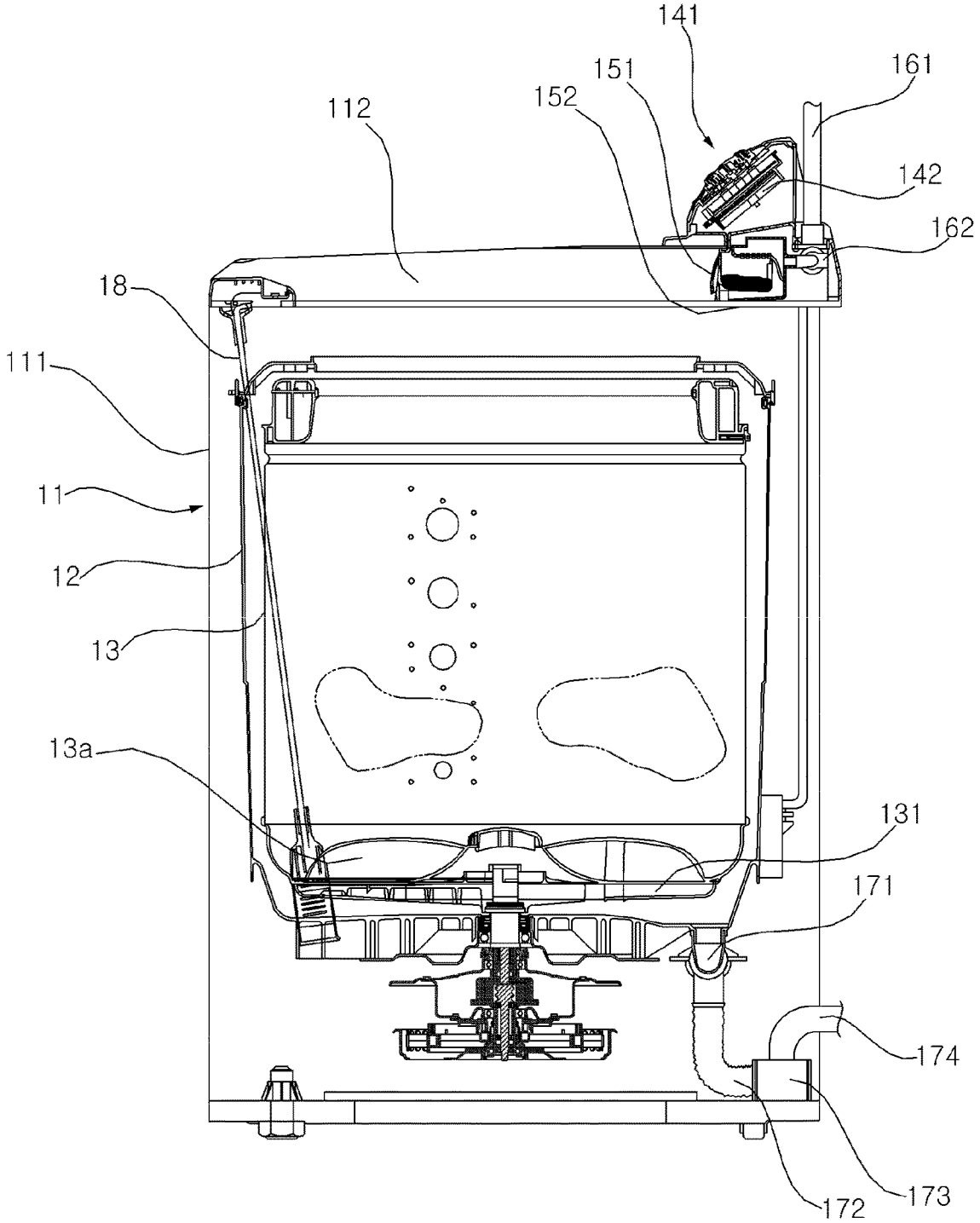
FIG. 1 is a schematic cross-sectional view of a washing machine comprising a drive assembly according to an exemplary embodiment of the present disclosure.
Figure 2:
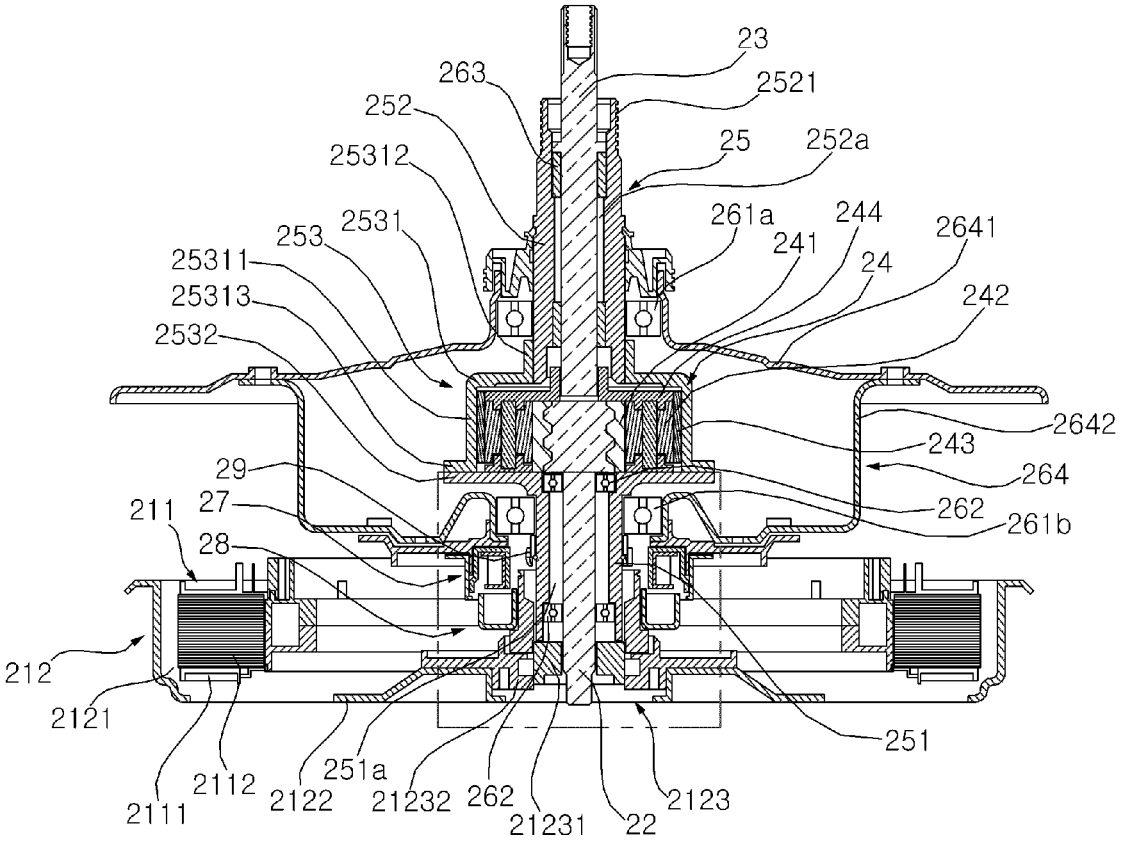
FIG. 2 is a cross-sectional view of a drive assembly according to an exemplary embodiment of the present disclosure.
Figure 3:
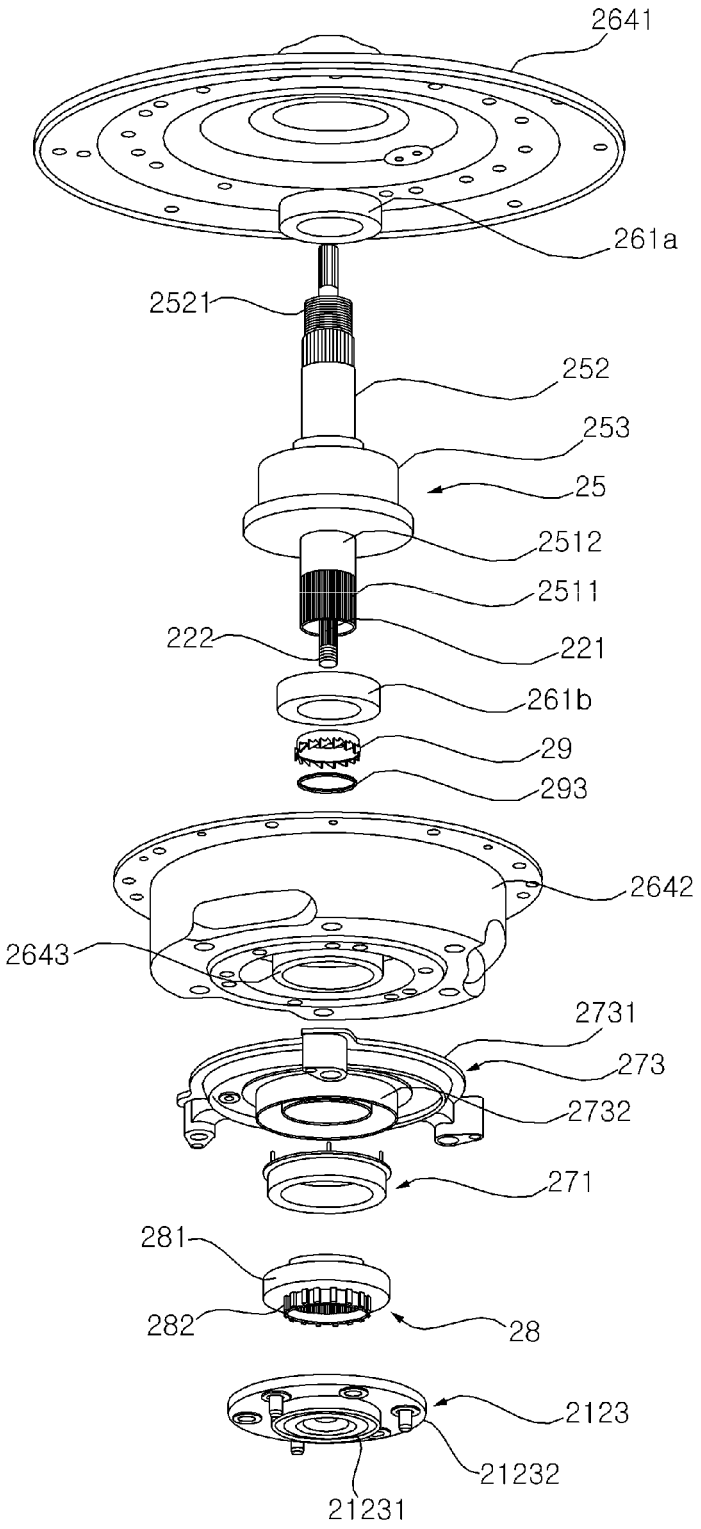
FIG. 3 is an exploded perspective view of some of the components of a drive assembly according to an exemplary embodiment of the present disclosure.
Figure 4:
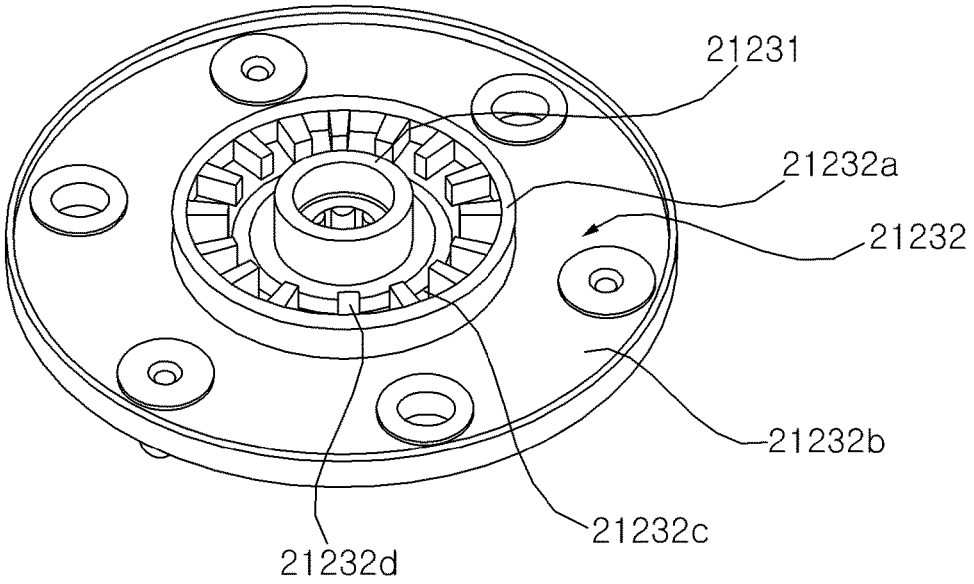
FIG. 4 is a perspective view of a rotor hub according to an exemplary embodiment of the present disclosure.
Figure 5:
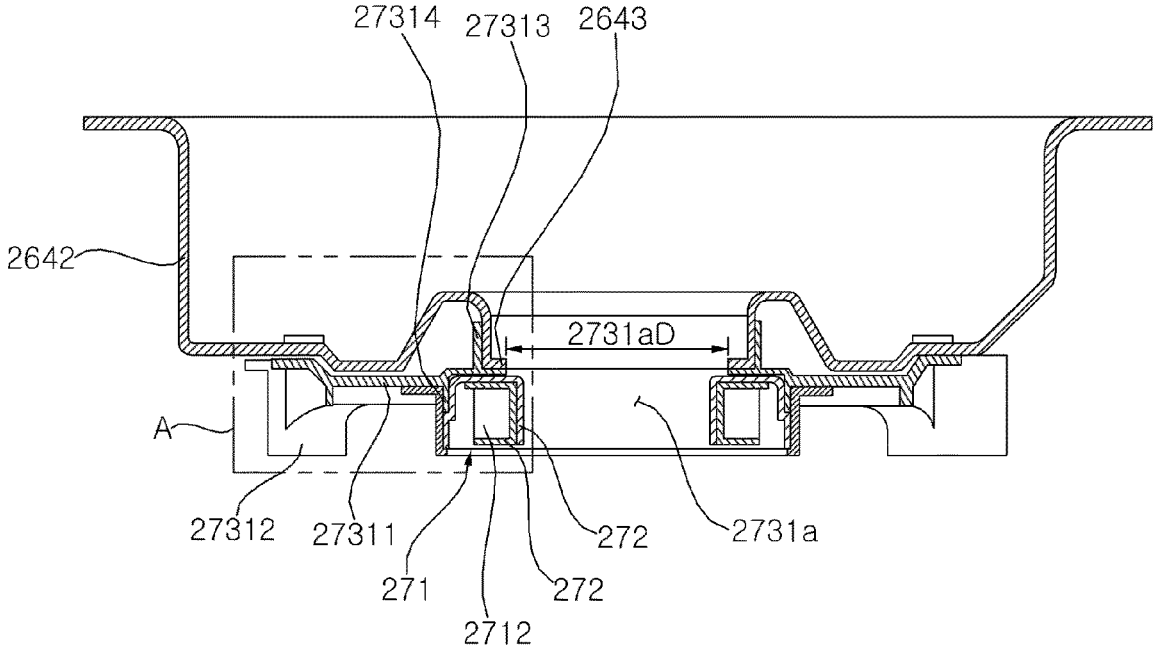
FIG. 5 is a cross-sectional view of a bearing housing and a solenoid module according to an exemplary embodiment of the present disclosure.
Figure 6:
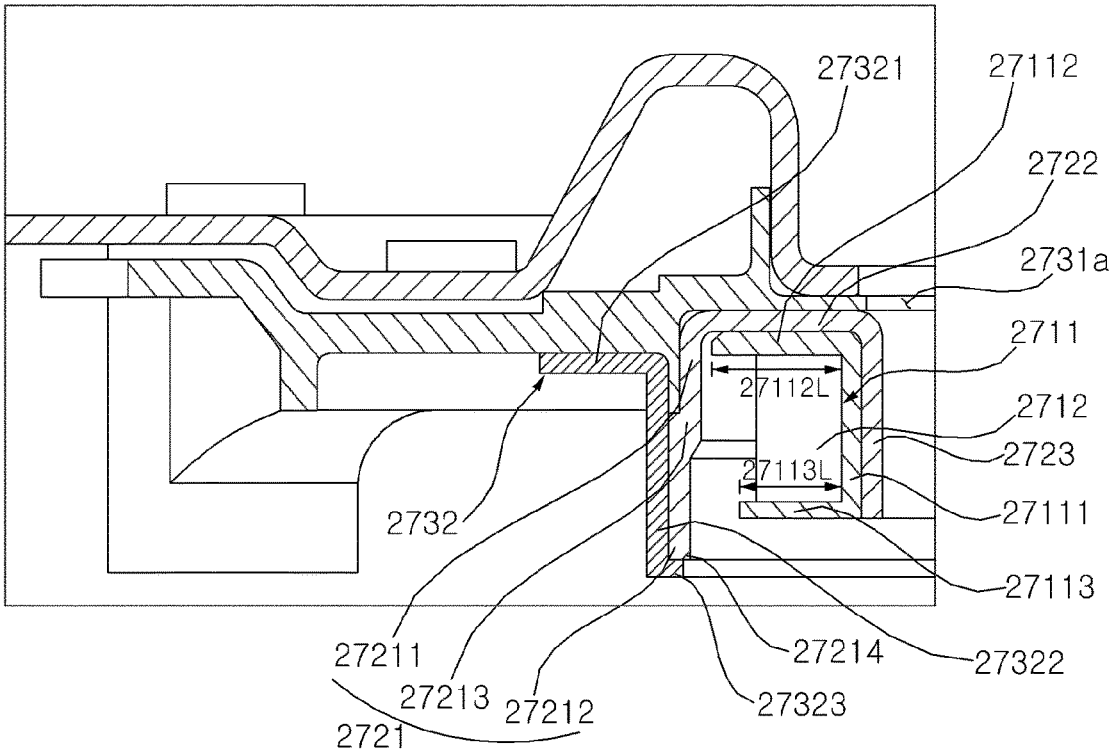
FIG. 6 is an enlarged view of A in FIG. 5.
Figure 7:
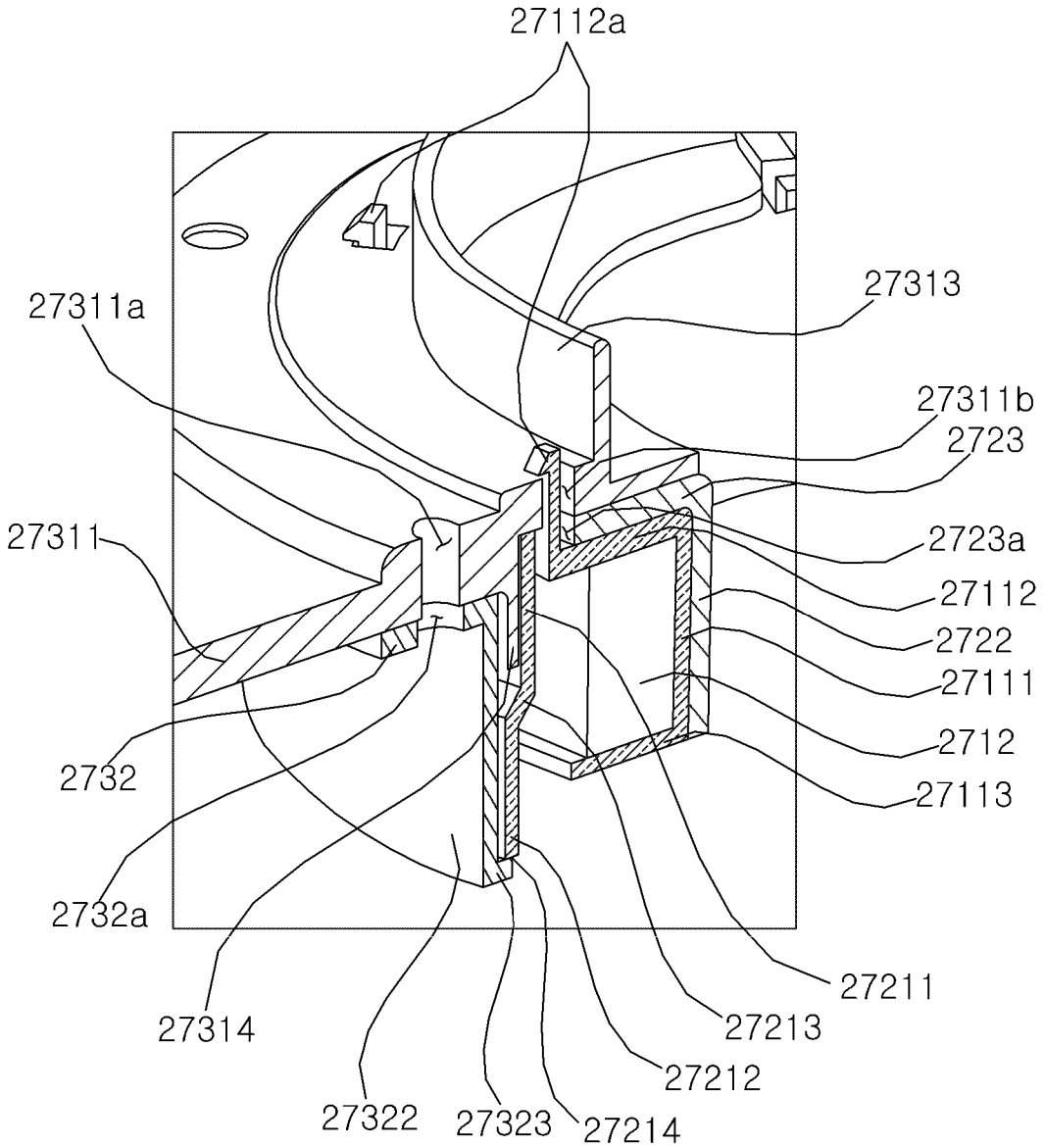
FIG. 7 is a cross-sectional perspective view of a bearing housing and a solenoid module according to an exemplary embodiment of the present disclosure.
Figure 8:
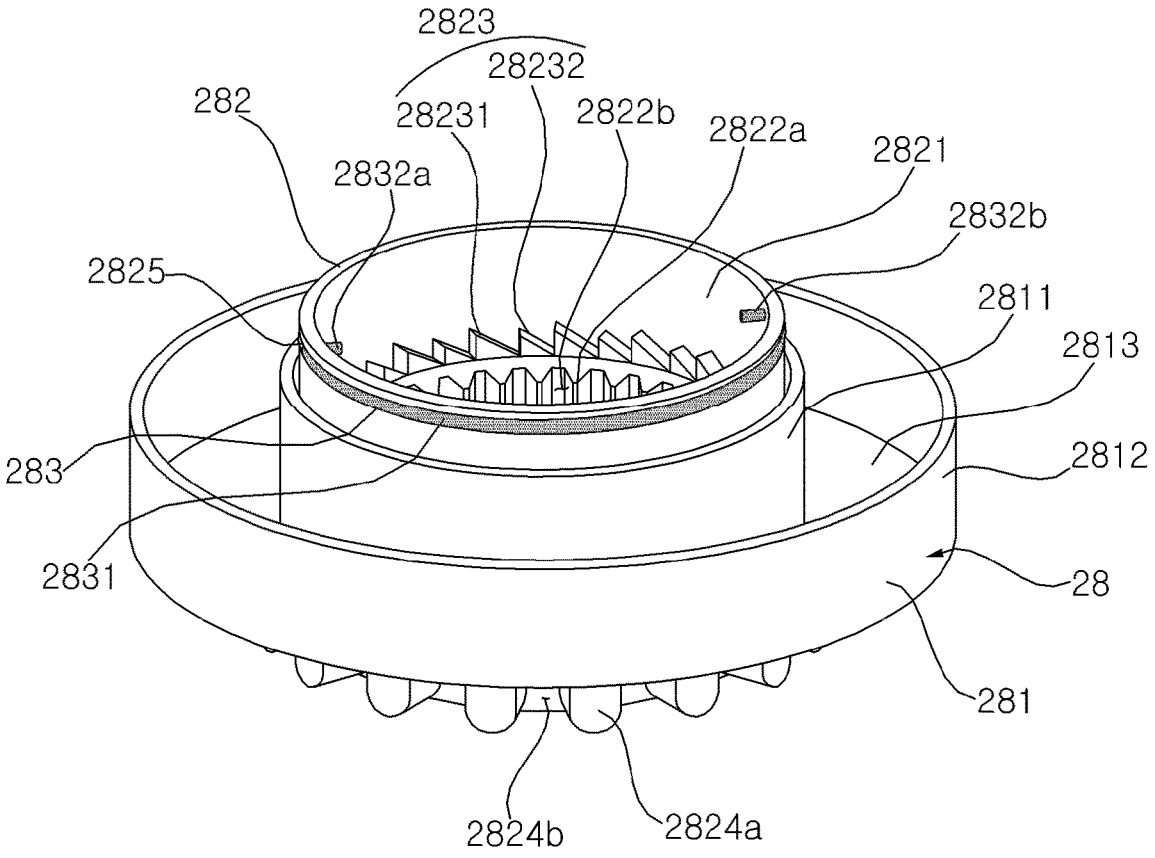
FIG. 8 is a perspective view of a coupler according to an exemplary embodiment of the present disclosure.
Figure 9:
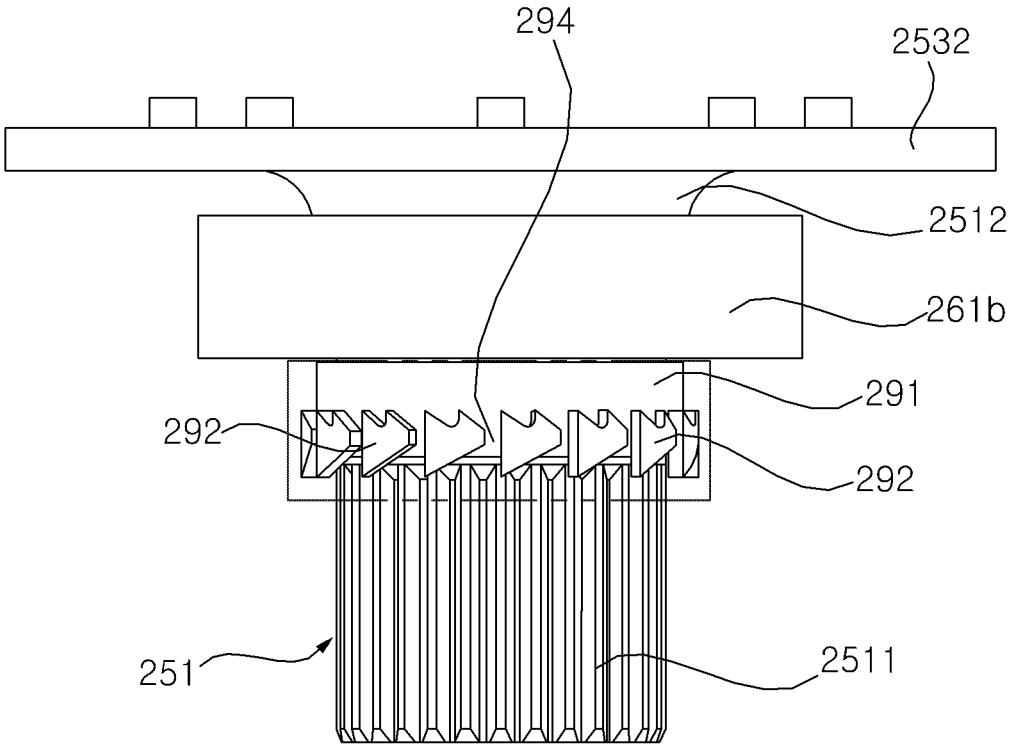
FIG. 9 is a view for explaining the coupling of a dewatering shaft and a coupler guide according to an exemplary embodiment of the present disclosure.
Figure 10:
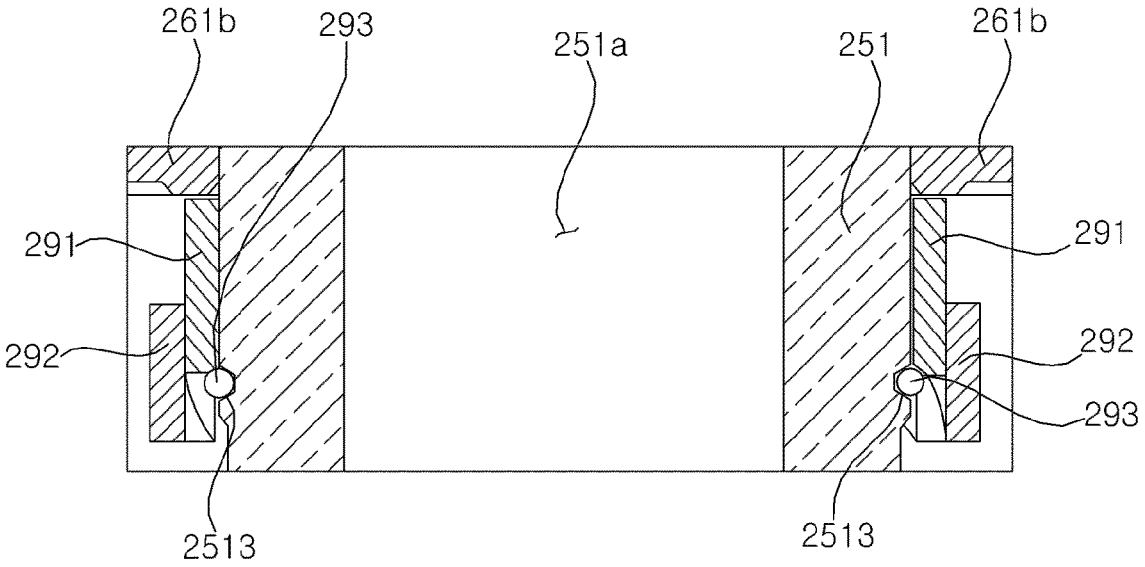
FIG. 10 is a cross-sectional view for explaining the coupling of a dewatering shaft and a coupler guide according to the present disclosure.
Figure 11:
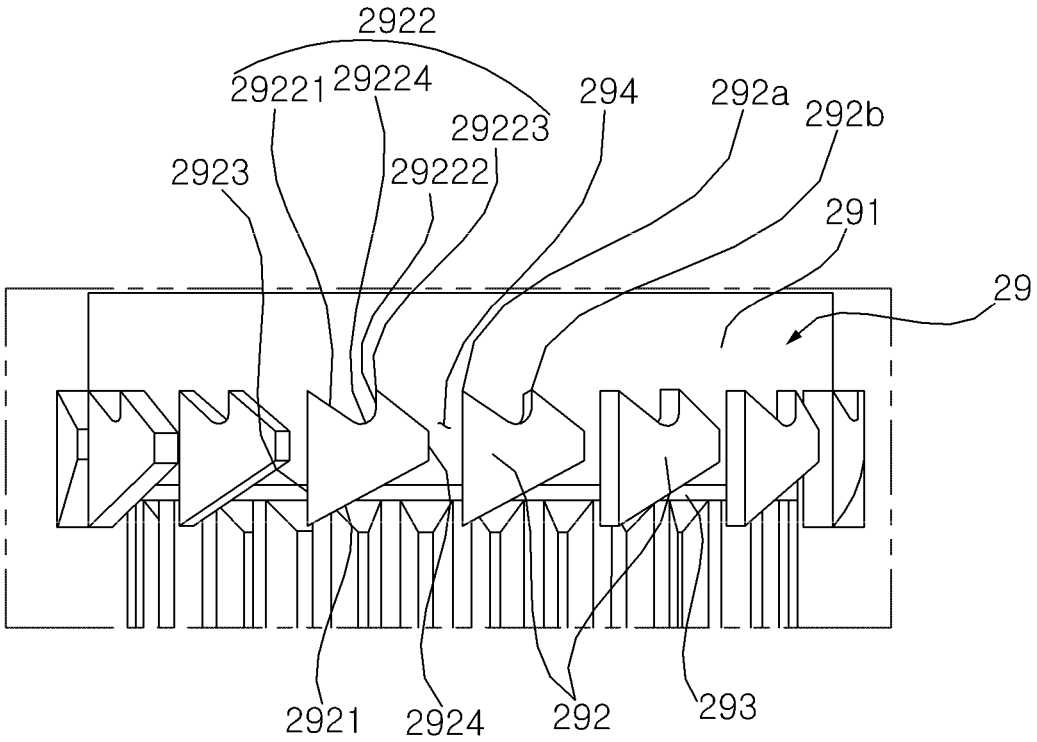
FIG. 11 is an enlarged view of B in FIG. 9.
Figure 12A:
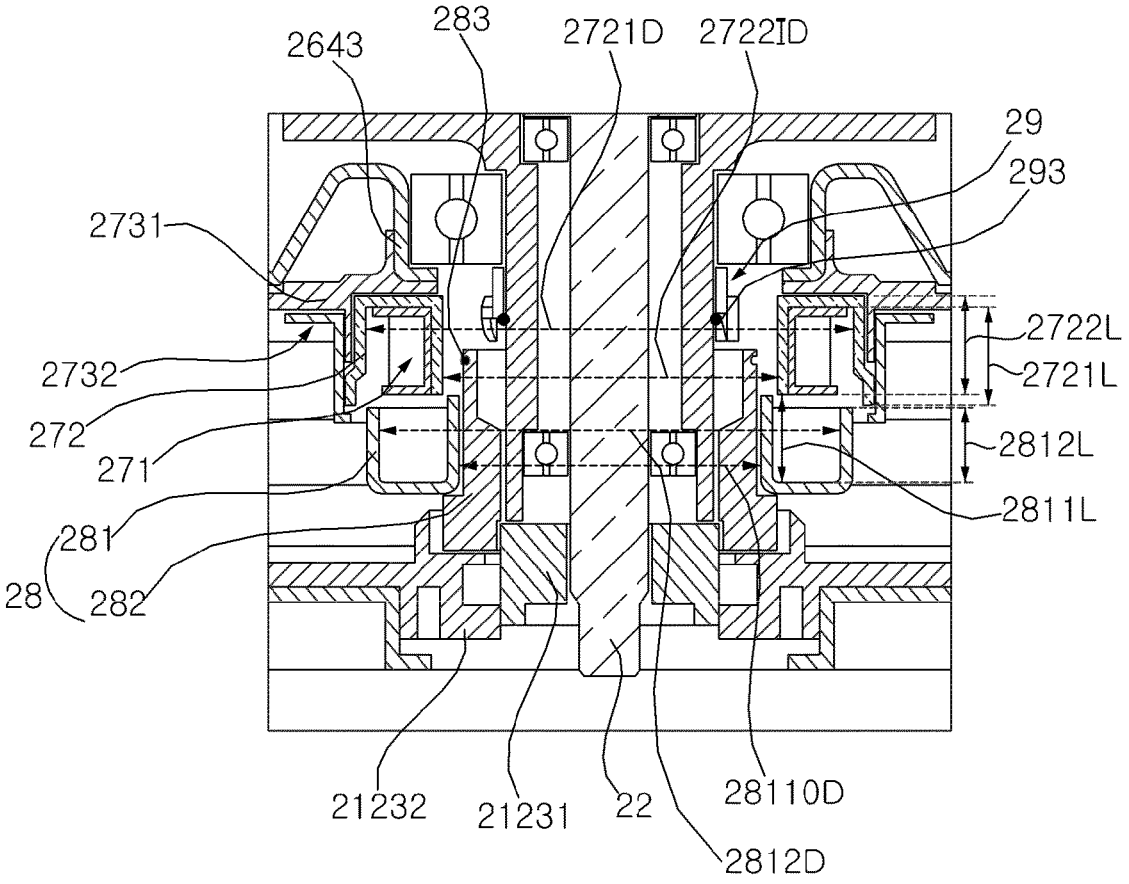
FIG. 12A is a cross-sectional view illustrating the configuration of a coupler, a solenoid module, and a coupler guide when the coupler is coupled to a coupling flange according to an exemplary embodiment of the present disclosure.
Figure 12B:
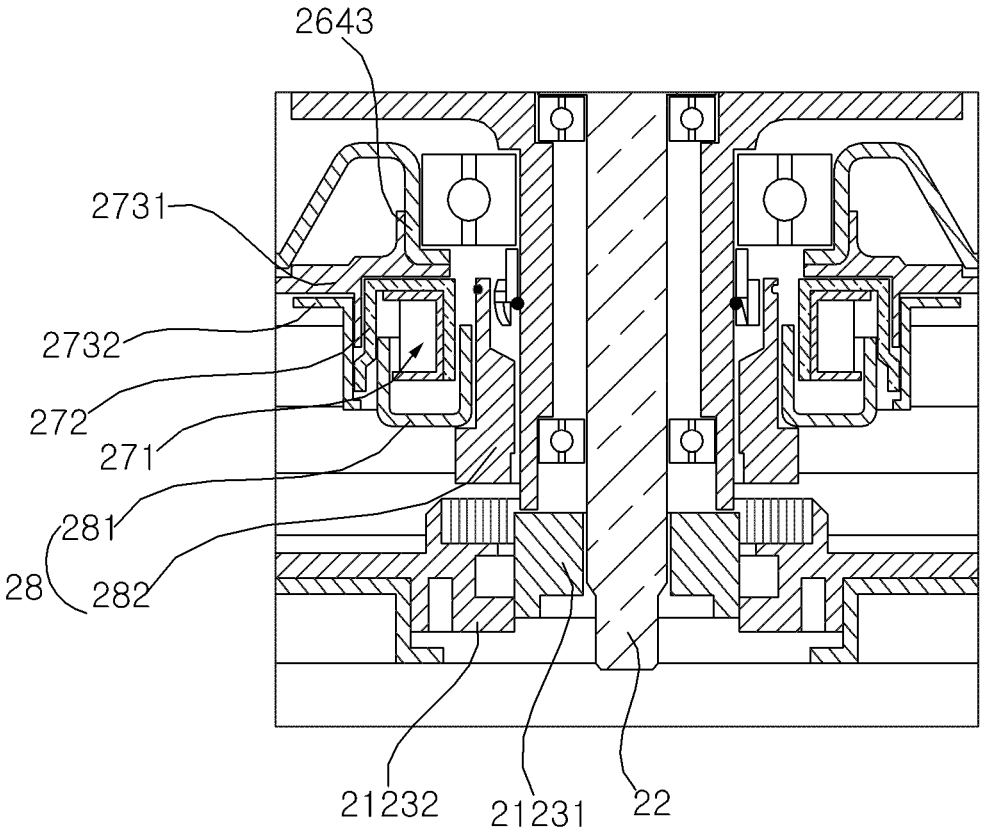
FIG. 12B is a cross-sectional view illustrating the configuration of a coupler, a solenoid module, and a coupler guide when the coupler is decoupled from a coupling flange according to an exemplary embodiment of the present disclosure.
Figure 13A:
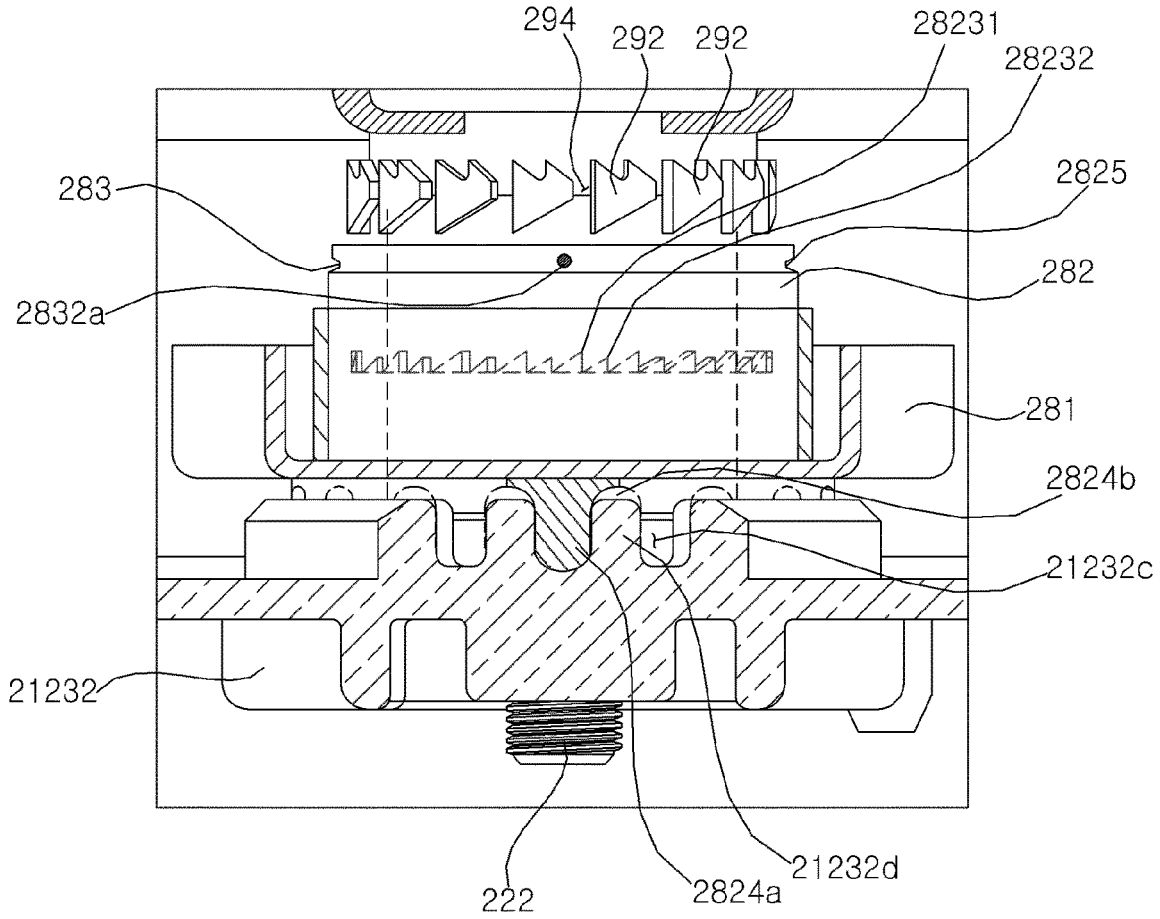
FIG. 13A is a view for explaining the relationship between a coupler and a coupling flange and the relationship between the coupler and a coupler guide, when the coupler is coupled to the coupling flange, according to an exemplary embodiment of the present disclosure.
Figure 13B:
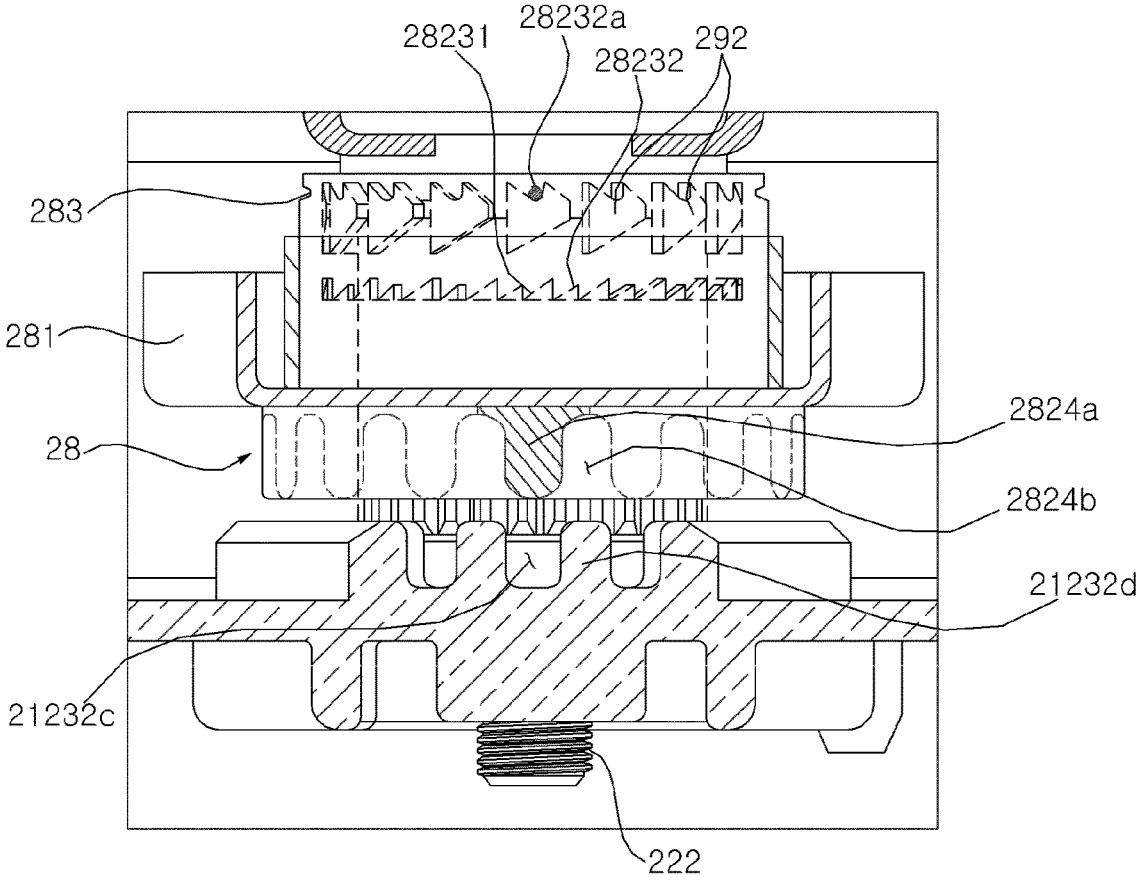
FIG. 13B is a view for explaining the relationship between a coupler and a coupling flange and the relationship between the coupler and a coupler guide, when the coupler is decoupled from the coupling flange, according to an exemplary embodiment of the present disclosure.

Advantages and features of the present disclosure and methods for achieving them will be made clear from embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is merely defined by the scope of the claims. Like reference numerals refer to like elements throughout the specification.

Hereinafter, the present disclosure will be described with reference to the drawings for explaining a washing machine according to exemplary embodiments of the present disclosure.

Overall Construction

Referring to FIG. 1, an overall structure of a washing machine will be briefly described below.

A washing machine according to an exemplary embodiment of the present disclosure may comprise a casing 11 which forms the exterior and forms a space on the inside where a water tank 12 is contained. The casing 11 may comprise a cabinet 111 with an open top, and a top cover 112 attached to the open top of the cabinet 111, with a loading opening approximately in the center through which laundry is loaded. A door (not shown) for opening and closing the loading opening may be rotatably attached to the top cover 112.

A suspension 18 for suspending the water tank 12 within the casing 11 may be provided. The upper end of the suspension 18 may be connected to the top cover 112, and the lower end may be connected to the water tank 12, and the suspension 18 may be provided at each of the four corners in the casing 11.

The control panel 141 may be provided on the top cover 112. An input part (for example, a button, a dial, a touchpad, etc.) for receiving various control commands from a user for operational control of the washing machine and a display (for example, an LCD, an LED display, etc.) for visually displaying the operating status of the washing machine may be provided on the control panel 141.

A water supply pipe 161 for guiding water supplied from an external source of water such as a water tap and a water supply valve 162 for controlling the water supply pipe 161 may be provided. The water supply valve 162 may be controlled by a controller 142. The controller 142 may control the overall operation of the washing machine, as well as the water supply valve 162. The controller 142 may comprise a microprocessor with a memory for data storage. Unless mentioned otherwise, it will be understood that the control of electric/electronic parts constituting the washing machine is done by the controller 142.

A drawer 151 for containing detergent may be slidably housed in a drawer housing 152. After water supplied through the water supply valve 162 is mixed with detergent as it passes through the drawer 151, the water is pumped into the water tank 12 or the washing tub 13. An outlet pipe 172 for releasing water out of the water tank 12 and a drainage valve 171 for controlling the outlet pipe 172 may be provided. Water released through the outlet pipe 172 may be forced out by a drainage pump 173 and released out of the washing machine through the drainage pipe 174.

The washing tub 13 holds laundry, and spins about a vertical axis within the water tank 12. A pulsator 13*a* is rotatably provided within the washing tub 13.

The washing tub 13 and the pulsator 13*a* may spin by means of a drive assembly 2. The drive assembly 2 may spin the pulsator 13*a* only or spin the washing tub 13 and the pulsator 13*a* simultaneously. The pulsator 13*a* spins in conjunction with a drive shaft 22 of the drive assembly 2. The washing tub 13 spins in conjunction with a dewatering shaft 25 of the drive assembly 2.

Drive Assembly

A drive assembly according to an exemplary embodiment of the present disclosure will be described below with reference to FIGS. 2 to 13B.

The drive assembly 2 spins the pulsator 13*a* or the washing tub 13. The drive assembly 2 comprises a drive motor 21 that rotates by electromagnetic force, a drive shaft 22 that rotates by the rotation of the drive motor 21 to spin the pulsator, a dewatering shaft 25 that rotates about the same axis as the drive shaft 22 and is connected to the washing tub 13, a solenoid module 27 that generates a magnetic field by applying an electric current to a coil 2712, a coupler 28 whose position is changed when the solenoid module 27 generates a magnetic field, and which axially couples the drive shaft 22 and the dewatering shaft 25 or decouples them from each other depending on the position, and a coupler guider 28 that keeps the drive shaft 22 and the dewatering shaft 25 axially decoupled from each other once they are axially decoupled by the coupler 28.

Here, the axial coupling of the drive shaft 22 and the dewatering shaft 25 means that a plurality of axial coupling teeth 2824*a* and axial coupling grooves 2824*b* formed on the bottom of the coupler 28 are configured to mesh with a plurality of tooth grooves 21232*c* and teeth 21232*d* on a coupling flange 21232 connected to the drive shaft 22, so that the drive shaft 22 and the dewatering shaft 25 are driven together.

The axial decoupling of the drive shaft 22 and the dewatering shaft 25 means that the bottom of the coupler 28 is spaced a certain distance upward from a coupling flange 21232, so that the drive shaft 22, even if driven by the drive motor 21, does not affect the dewatering shaft 25.

The drive motor 21 may be an outer rotor-type BLDC (brushless direct current) motor. Specifically, the drive motor 21 may comprise a stator 211 with a stator coil 2112 wound around a stator core 2111 and a rotor 211 rotates by an electromagnetic force acting between the rotor 211 and the stator core 211. The rotor 212 may comprise a rotor frame 2122 that fixes a plurality of permanent magnets 2121 spaced apart along the circumference and a rotor hub 2123 that connects the center of the rotor frame 2122 to the drive shaft 22.

The type of the drive motor 21 is not limited to the above one. For example, the drive motor may be an inner rotor, an AC motor such as an induction motor or shaded pole motor, or other various types of well-known motors.

The rotor hub 2123 may comprise a rotor bush 21231 that is attached to the drive shaft 22 and a coupling flange 21232 for attaching the rotor bush 21231 to the center of the rotor frame 2122. The coupling flange 21232 may comprise a tubular flange body 21232*a* into which the rotor bush 21231 is inserted, and a flange portion 21232*b* that extends outward from the flange body 21232*a* and is attached to the rotor frame 2122 by a fastening member such as a screw or bolt. Engaging grooves 21232*c* and teeth 21232*d* that mesh with the coupler 28, which will be described later, may intersect on the inner periphery of the flange body 21232*a*.

The rotor bush 21231 may be made of metal (preferably but not limited to stainless steel). The rotor bush 21231 may be attached to the drive shaft 22; preferably, the inner periphery of the rotor bush 21231 may be attached to the outer periphery of the drive shaft 22 via a spline.

Here, the expression "attached via a spline" means that a spline such as an axially extending tooth or key is formed on either the drive shaft 22 or the rotor bush 21231 and a groove that meshes with the spline is formed on the other, causing the spline and the groove to engage each other. With this engagement, when the rotor bush 21231 rotates, the drive shaft 22 rotates too.

The coupling flange 21232 is made of synthetic resin and interposed between the rotor bush 21231 and the rotor frame 2122, and functions to insulate them to prevent the transmission of magnetic flux from the rotor frame 2122 to the rotor bush 21231.

The coupling flange 21232 is formed by injection-molding synthetic resin, with the rotor bush 21231 being inserted in a mold, thereby forming the rotor bush 21231 and the coupling flange 21232 as a single unit.

The drive shaft 22 rotates in conjunction with the rotor bush 21231. The drive shaft 22 spins the pulsator 13*a* through a pulsator shaft 23. The drive shaft 22 may be connected directly or indirectly to the pulsator shaft 23.

The drive assembly 2 may comprise a pulsator shaft 23 that is connected to the pulsator 13*a* and spins the pulsator 13*a* and a gear module 24 that receives torque from the drive shaft 22 and rotates the pulsator shaft 23 by converting output depending on the speed ratio or torque ratio for the rotation of the drive shaft 22.

In some embodiments, the gear module may be omitted, and the drive shaft 22 may be connected directly to the pulsator 13*a*.

The gear module 24 comprises a sun gear 241 that rotates in conjunction with the drive shaft 22, a plurality of planet gears 242 that mesh with the sun gear 241 and revolve along the outer periphery of the sun gear 241 as they rotate, a ring gear 243 that rotates by meshing with the plurality of planet gears 242, and a carrier 244 that provides an axis of rotation to each of the planet gears 242 and rotates when the plane gears 242.

The sun gear 241 is connected to the drive shaft 22 and rotates in unison with the drive shaft 22. In the exemplary embodiment, the sun gear 241 is a helical gear, and the planet gears 242 and the ring gear 243 are configured to have corresponding helical gear teeth but not limited to them. For example, the sun gear 241 may be a spur gear, and the plane gears 242 and the ring gear 243 may have spur gear teeth.

The ring gear 243 may be fixed to the inner periphery of the gear housing 253. That is, the ring gear 243 rotates in unison with the gear housing 253. The ring gear 243 has teeth on the inner periphery which defines a ring-shaped opening.

The planet gears 242 are interposed between the sun gear 241 and the ring gear 243 and engage the sun gear 241 and the ring gear 243. The plane gears 242 may be arranged around the sun gear 241, and the plane gears 242 are rotatably supported by the carrier 244. The planet gears 242 may be made of acetal resin (POM).

The carrier 244 is coupled (axially coupled) to the pulsator shaft 23. The carrier 244 is a kind of link that connects the planet gears 242 and the pulsator shaft 23. That is, the carrier 244 rotates as the planet gears 242 revolve around the sun gear 241, and therefore the pulsator shaft 23 rotates.

The gear module 24 rotates the pulsator shaft 23 by converting a torque inputted through the drive shaft 22 according to a set gear ratio. The gear ratio may be set depending on the number of teeth in the sun gear 241, planet gears 242, and ring gear 243.

The dewatering shaft 25 comprises a lower dewatering shaft 251 attached to the coupler 28 via a spline to rotate together with the coupler 28, an upper dewatering shaft 252 connected to the washing tub 13 to rotate the washing tub 13, and a gear housing 253 disposed between the lower dewatering shaft 251 and the upper dewatering shaft 252, with the gear module 24 disposed on the inside.

The lower dewatering shaft 251 is disposed above the rotor bush 21231. The lower dewatering shaft 251 may be connected to the drive motor 21 via the coupler 28. When the coupler 28 is axially coupled to the coupling flange 21232, the torque of the drive motor 21 may be transmitted to the dewatering shaft 25.

A drive shaft hole 251*a* through which the drive shaft 22 passes is formed on the inside of the lower dewatering shaft 251. A drive shaft bearing 252 is disposed between the lower dewatering shaft 251 and the drive shaft 22, so that the lower dewatering shaft 251 and the drive shaft 22 may rotate separately.

The outer periphery of the lower dewatering shaft 251 is attached to the inner periphery of the coupler 28 via a spline. The coupler 28, while held back from rotating relative to the lower dewatering shaft 251, may move along the axis of the lower dewatering shaft 251.

A spline structure where the coupler 28 is attached via a spline is formed at a lower portion 2511 of the lower dewatering shaft 251. An upper portion 2512 of the lower dewatering shaft 251 may be made smooth so that the coupler guide 29 is rotatably mounted to it. The coupler guide 29, which will be described below, is mounted around the upper portion 2512 of the lower dewatering shaft 251. The inner circumferential diameter ID2 of the coupler guide 29 is longer than the outer circumferential diameter OD2 of the lower dewatering shaft 251, allowing the coupler guide 29 to be rotatably mounted around the lower dewatering shaft 251.

Incidentally, the coupler guide 29 is restrained from moving downward by means of a stationary ring 293 fixedly disposed on the outer perimeter of the lower dewatering shaft 251, and is restrained from moving upward by means of a dewatering shaft bearing 251 disposed at the upper portion 2512 of the lower dewatering shaft 251 so as to support the lower dewatering shaft 251.

A stationary ring groove 2513 recessed inward along the radius is formed on the outer perimeter of the lower dewatering shaft 251 so that the stationary ring 293 is mounted to it.

The upper dewatering shaft 252 is connected to the washing tub 13, and has a pulsator shaft hole 252*a* formed on the inside through which the pulsator shaft 23 passes. A pulsator shaft bearing 263 is disposed between the upper dewatering shaft 252 and the pulsator shaft 23, allowing the upper dewatering shaft 252 and the pulsator shaft 23 to rotate freely and separately.

The upper dewatering shaft 252 may be made of ferromagnetic material. The upper dewatering shaft 252 may be connected to the washing tub 13 by a hub base 131. The hub base 131 is attached to the bottom of the washing tub 13, and a fastener through which the upper dewatering shaft 252 passes is formed in the center of the hub base 131. The upper dewatering shaft 252 is coupled to the inner periphery of the fastener via a spline, and rotates together with the hub base 131 when the upper dewatering shaft 252 rotates. A nut (not shown) for holding the dewatering shaft 25 in place to prevent its removal from the hub base 131 may be fastened to an upper end 2521 of the upper dewatering shaft 252.

The gear housing 253 forms a space on the inside where the gear module 24 is disposed, and is fastened to the upper dewatering shaft 252 on the upper side and connected to the lower dewatering shaft 251 on the lower side. The gear housing 253 may comprise a lower gear housing 2532 and an upper gear housing 2531.

The lower gear housing 2532 and the upper gear housing 2531 are held together by a fastening member such as a screw or bolt. The lower gear housing 2532 has a hole in the center through which the drive shaft 22 passes, is disk-shaped, and is fastened to the upper gear housing 2531 on the upper side. The lower dewatering shaft 251 extends downward from the lower gear housing 2532, and the lower gear housing 2532 may be formed integrally with the lower dewatering shaft 251.

A boss 25311 attached to the upper dewatering shaft 252 is formed on the upper gear housing 2531, and the upper side of the space where the gear module 24 is contained is opened by the boss 25311. The upper gear housing 2531 comprises a housing body that forms an inner periphery surrounding the ring gear 243 and an upper flange 25113 that extends outward along the radius from the open bottom of the housing body 25312 and is attached to the lower gear housing 253. The boss 25311 extends upward from the housing body 25312.

The drive assembly 2 may further comprise a bearing housing 264 that is disposed under the water tank 12 and supports the dewatering shaft 25.

The bearing housing 264 forms a space on the inside where the dewatering shaft 25 is rotatably disposed. The bearing housing 264 may be attached to the underside of the water tank 12. The bearing housing 264 may be made of ferromagnetic material. The bearing housing 264 comprises an upper bearing housing 2641 attached to the underside of the water tank 12 and a lower bearing housing 2642 attached to the upper bearing housing 2641 on the lower side of the upper bearing housing 2641. The dewatering shaft 25 is disposed in an inner space where the upper bearing housing 2641 and the lower bearing housing 2642 are attached.

A dewatering shaft bearing 261 is disposed between the bearing housing 264 and the dewatering shaft 25 so as to rotatably support the dewatering shaft 25. A first dewatering shaft bearing 261*a* is disposed between the upper bearing housing 2641 and the upper dewatering shaft 252, and a second dewatering shaft bearing 261*b* is disposed between the lower bearing housing 2642 and the lower dewatering shaft 251.

The lower bearing housing 2642 comprises a lower insert portion 2643 that projects downward and is inserted into a bearing housing mounting portion 27313 of a solenoid housing 273 to be described later. The lower insert portion 2643 is inserted into the bearing housing mounting portion 27313, so that the bearing housing 264 and the solenoid housing 273 can be easily fastened together.

Solenoid Module

The solenoid module 27 forms a magnetic field when an electric current is applied to it, thus moving the coupler 28 upward. The solenoid module 27 may be fixedly disposed under the bearing housing 264. The solenoid module 27 comprises a solenoid 271 that forms a magnetic field when an electric current is applied to it, a fixed core 272 surrounding one side of the perimeter of the solenoid 271, and a solenoid housing 273 that allows the solenoid 271 to be fixedly disposed under the bearing housing 264.

The solenoid housing 273 is fixedly disposed under the bearing housing 264. The solenoid housing 273 may be fixed to the bottom of the bearing housing 264 via a separate fastening member.

The solenoid housing 273 may be roughly disk-shaped and have a dewatering shaft hole 2731*a* in the center through which the dewatering shaft 25 passes. The inner periphery of the solenoid housing 273 with the dewatering shaft hole 2731*a* in it is spaced apart from the dewatering shaft 25. The solenoid 271 is fixedly disposed on the inner periphery of the solenoid housing 273.

The solenoid housing 273 may be fixedly disposed on the bearing housing 264, which is disposed above it, via a separate fastening member (not shown). The solenoid housing 273 may comprise an upper solenoid housing 2731 fastened to the bearing housing 264 and a lower solenoid housing 2732 attached to the upper solenoid housing 2731, under the upper solenoid housing 2731.

The upper solenoid housing 2731 comprises a disk-shaped fixed plate 27311 with a dewatering shaft hole 2731*a* in the center, a bearing housing fastening portion 27312 with a fastening hole (not shown) so as to fasten the fixed plate 27311 to the bearing housing 264, a bearing housing mounting portion 27313 protruding upward, radially spaced a certain distance apart from the inner peripheral edge of the fixed plate 27311, into which the lower insert portion 2643 of the bearing housing 264 is inserted, and a fixed core fixing portion 27314 protruding downward, radially spaced a certain distance apart from the inner peripheral edge of the fixed plate 273*a*, into which the fixed core 272 is inserted.

The fixed plate 27311 is roughly disk-shaped and has a dewatering shaft hole 2731*a* in the center through which the dewatering shaft 25 passes. The diameter 2731*a*D of the dewatering shaft hole 2731*a* is larger than the diameter of the outer periphery of the dewatering shaft 25 positioned in the dewatering shaft hole 2731*a*. Accordingly, the dewatering shaft 25 does not interfere with the solenoid housing 273 when it rotates. A space where the coupler 28 and some of the components of a moving core 281 are disposed when the coupler 28 moves upward is formed between the dewatering shaft 25 and the dewatering shaft hole 2731*a*.

A hook hole 27311*b* through which a hook 27112*a* of a bobbin 2711 passes is formed in the fixed plate 27311. The fixed plate 27311 has a fastening hole 27311*a* fastened to the lower solenoid housing 2732 by a separate fastening means.

The bearing housing mounting portion 27313 protrudes vertically upward from the fixed plate 27311. The bearing housing mounting portion 27313 may have the shape of a ring into which the lower insert portion 2643 of the bearing housing 264 is inserted down. The fixed core fixing portion 27314 protrudes vertically downward from the fixed plate 27311. The fixed core fixing portion 27314 has the shape of a ring into which the fixed core 272 is inserted up. The fixed core 272 is firmly attached and inserted to the inner periphery of the fixed core fixing portion 27314. The lower solenoid housing 2732 is mounted to the outer periphery of the fixed core fixing portion 27314.

The lower solenoid housing 2732 is mounted to the bottom surface of the upper solenoid housing 2731. The lower solenoid housing 2732 may be fastened to the upper solenoid housing 2731 by a separate fastening means (not shown). The lower solenoid housing 2732 has a fastening hole 2732*a* through which the separate fastening means is inserted.

The lower solenoid housing 2732 comprises a top surface portion 27321 that makes surface contact with the upper solenoid housing 2731, a peripheral portion 27322 protruding vertically downward from the inner peripheral edge of the top surface portion 27321, and a protruding portion 27323 that is vertically bent and protrudes toward the center from the bottom end of the peripheral portion 27322.

The top surface portion 27321 is fastened to the upper solenoid housing 2731 and has a fastening hole 2732*a*. The peripheral portion 27322 makes surface contact with the outer periphery (외둘레면) of the fixed core fixing portion 27314 of the upper solenoid housing 2731, extends downward, and surrounds the lower periphery (하부둘 레면) of the fixed core 272. The protruding portion 27323 is disposed to support a lower end 27214 of the fixed core 272 and restrains the downward movement of the fixed core 272.

The upper solenoid housing 2731 and the lower solenoid housing 2732 may be configured as a single unit.

The solenoid 271 has a coil wound around the dewatering shaft 25. The solenoid 271 may comprise a bobbin 2711 and a coil 2712 wound around the bobbin 2711. The bobbin 2711 has a hollow through which the dewatering shaft 25 passes, and the coil 2712 is wound around the outer perimeter of the bobbin 2711.

The coil 2712 may be covered with flame retardant resin. The bobbin 2711 may comprise a cylindrical bobbin body portion 2711 around which the coil 2712 is wound, an upper plate portion 27112 extended outward from the upper end of the bobbin body portion 27111, and a lower plate portion 27113 extended outward from the lower end of the bobbin body portion 27111.

The bobbin 2711 comprise a hook 27112*a* protruding upward from the upper plate portion 27112. The hook 27112*a* may penetrate through the hook hole 27311*b* of the solenoid housing 273 and be fixedly disposed in the solenoid housing 273. The hook 27112*a* may penetrate through a hook hole 2723*a* formed in the fixed core 272, penetrate through the hook hole 27311*b* of the solenoid housing 273, and be fixed to the hook hole 27311*b* of the solenoid housing 273, thus allowing both the solenoid 271 and the fixed core 272 to be fixed to the solenoid housing 273.

The bobbin body portion 27111 may be disposed to make surface contact with the outer periphery of an inner fixed core 2722 of the fixed core 272. The bobbin body portion 27111 may be press-fitted to the outer periphery of the inner fixing core 2722 and fixedly disposed in the fixed core 272.

The upper plate portion 27112 and the lower plate portion 27113 extend radially from the bobbin body portion 2711. The length 27112L to which the upper plate portion 27112 extends radially from the bobbin body portion 27111 is greater than the length 27113L to which the lower plate portion 27113 extends radially from the bobbin body portion 27111.

The fixed core 272 has a structure that surrounds the perimeter of the solenoid 271. The fixed core 272 forms a magnetic path through which a magnetic field generated by the solenoid passes. The fixed core 272 has the shape of a ring which is hollow inside and open at the bottom. The moving core 281 may move to the open bottom of the fixed core 272.

The fixed core 272 comprises an outer fixed core 2721 that forms the outer periphery and is attached to the solenoid housing 273, an inner fixed core 2722 that forms the inner periphery and is attached to the solenoid 271, and a connecting fixed core 2723 that connects the upper ends of the outer fixed core 2721 and inner fixed core 2722.

The outer fixed core 2721 is mounted to the fixed core fixing portion 27314 of the upper solenoid housing 2731 and the peripheral portion 27322 of the lower solenoid housing 2732. The outer fixed core 2721 is disposed to make surface contact with the fixed core fixing portion 27314 of the upper solenoid housing 2731 and the peripheral portion 27322 of the lower solenoid housing 2732. The outer fixed core 2721 comprises an upper outer fixed core 27211 that makes surface contact with the fixed core fixing portion 27314, a lower outer fixed core 27212 that makes surface contact with the peripheral portion 27322 of the lower solenoid housing 2732, and an extended portion 27213 that connects the upper outer fixed core 27211 and the lower outer fixed core 27212. Through the extended portion 27213, the radius of the lower outer fixed core 27212 may be increased, and the lower outer fixed core 27212 may be disposed to make surface contact with the lower solenoid housing 2732.

The lower end 27214 of the outer fixed core 2721 is fixedly disposed by contact with the protruding portion 27323 of the lower solenoid housing 2732.

The inner fixed core 2722 is spaced a certain distance apart from the outer fixed core 2721. A space where the bobbin 2711 is disposed and a space where an outer moving core 2812 is disposed are formed between the inner fixed core 2722 and the outer fixed core 2721.

The inner fixed core 2722 is disposed to abut the bobbin body portion 27111 of the bobbin 2711. The bobbin 2711 is press-fitted to the inner fixed core 2722 and disposed to make surface contact with it.

The connecting fixed core 2723 is disposed to make surface contact with the fixed plate 27311. The connecting fixed core 2723 connects the inner fixed core 2722 and the upper end of the outer fixed core 2721. The connecting fixed core 2723 has a hook hole 2723*a* through which the hook 27112*a* penetrates, where the hook 27112*a* of the bobbin 2711 is formed.

The length 2721L to which the outer fixed core 2721 extends downward from the connecting fixed core 2723 is greater than the length 2722L to which the inner fixed core 2722 extends downward from the connecting fixed core 2723.

Coupler

The coupler 28 may be mounted in such a way as to move up and down the lower dewatering shaft 251 and may axially couple or decouple the drive shaft 22 and the dewatering shaft 25. The coupler 28 is provided under the solenoid 271 in such a way as to move up and down the dewatering shaft 25. The coupler 28 may be attached to the lower dewatering shaft 251 via a spline and move up and down the lower dewatering shaft 251.

The coupler 28 comprises a moving core 281 that forms a path of a magnetic flux formed by the solenoid 271 and moves up when an electric current is applied to the solenoid 271, a coupler body 282 that moves up and down the dewatering shaft 25 by the moving core 281 and axially couples or decouples the drive shaft 22 and the dewatering shaft 25, and a guide member 283 that protrudes from the periphery of the coupler body 282 and adjusts the position of the coupler 28.

The moving core 281 is mounted on the outer perimeter of the coupler body 282 and moves the coupler body 282 upward. The moving core 281 may be fixed to the coupler body 282 and move together with the coupler body 282. The moving core 281 moves the coupler body 282 upward when an electric current is applied to the solenoid 271. When there is no electric current applied to the solenoid 271, the coupler body 282 and the moving core 281 move downward by gravity.

The moving core 281 may move up by an electromagnetic interaction with the solenoid 271. The coupler body 282 and the moving core 281 may be formed as a single unit since the coupler body 282 is formed by injection-molding synthetic resin, with the moving core 281 inserted in a mold.

The moving core 281 comprises an inner moving core 2811 that forms the inner periphery and is attached to the coupler body 282, an outer moving core 2812 that forms the outer periphery and is radially spaced a certain distance apart from the inner moving core 2811, and a connecting moving core 2813 that connects the lower ends of the inner moving core 2811 and outer moving core 2812.

The height 2811L to which the inner moving core 2811 extends upward from the connecting moving core 2813 is greater than the height 2812L to which the outer moving core 2812 extends upward from the connecting moving core 2813. The distance 2813 by which the inner moving core 2811 is separated from the outer moving core 2812 is greater than the sum of the thickness of the inner fixed core 2722 and the length 27113L of the lower plate portion 27113 of the bobbin 2711. Accordingly, when the moving core 281 moves upward along the dewatering shaft 25, the bobbin 2711 and the inner fixed core 2722 may be disposed in an inner space formed by the moving core 281.

The diameter 2811OD of the outer periphery of the inner moving core 2811 is smaller than the diameter 2722ID of the inner periphery of the inner fixed core 2722. The diameter 2812D of the ring-shaped outer moving core 2812 is smaller than the diameter 2721D of the outer fixed core 2721 and greater than the diameter 2722D of the inner fixed core 2722.

The coupler body 282 has an overall cylindrical shape, and has a dewatering shaft insert hole 282*a* in the center through which the dewatering shaft 25 is inserted. The coupler body 282 may; be made of, but not limited to, synthetic resin, and also may be made of metal (for example, ferromagnetic material).

The coupler body 282 further comprises dewatering shaft moving guides 2822*a* and 2822*b* that engage the outer perimeter of the dewatering shaft 25 on the inner periphery of the coupler body 282, so as to fix the circumferential movement of the dewatering shaft 25 and allow for the longitudinal movement of the dewatering shaft 25.

As the inner periphery defining the dewatering shaft insert hole 282*a* is attached via a spline to the outer periphery of the dewatering shaft 25, the dewatering shaft guides 2822*a* and 2822*b* may move up and down the dewatering shaft, while the coupler is stopped from rotating relative to the dewatering shaft 25. The dewatering shaft guides 2822*a* and 2822*b* may have a plurality of spline teeth 2822*a* and spline grooves 2822*b* on the inner periphery of the coupler body 282 which engage the outer periphery of the dewatering shaft 25.

A stopper 2823 with a sloping side that abuts guide projections 292 of the coupler guide 29, which is to be described below, may be formed on the inner periphery 2821 of the coupler body 282. A plurality of stoppers 2823 are disposed along the inner periphery of the coupler body 282.

The stoppers 2823 are disposed over the spline teeth 2822*a* and spline grooves 2822*b* formed on the inner periphery 2821 of the coupler body 282.

The stoppers 2823 on the inner periphery 2821 of the coupler body 282 comprise first stoppers 28231 with a sloping surface and second stoppers 28232 disposed on one side of the first stoppers 28231 and made smaller in size and height than the first stoppers 2823.

The first stoppers 28231 and the second stoppers 28232 have a sloping surface which slopes at the same angle. The number of first stoppers 28231 disposed on the inner periphery of the coupler body 282 and the number of second stoppers 28232 disposed on the inner periphery of the coupler body 282 are equal. The first stoppers 2821 and the second stoppers 28232 are alternately disposed on the inner periphery of the coupler body 282. The second stoppers 28232 are disposed on both ends of the first stoppers 28231, and the first stoppers 28231 are disposed on both ends of the second stoppers 28232.

The first stoppers 28231 each comprise a first stopper sloping surface 28231*a* and a first stopper vertical surface 28231*b* that is bent and extends downward from the upper end of the first stopper sloping surface 28231*a*. The second stoppers 28232 each comprise a second stopper sloping surface 28232*a* and a second stopper vertical surface 28232*b* that is bent and extends downward from the upper end of the second stopper sloping surface 28232*a*. The first stopper sloping surface 28231*a* and second stopper vertical surface 28231*b* formed on each of the first stoppers 28231 are made longer than the second stopper sloping surface 28232*a* and second stopper vertical surface 28232*b* formed on each of the second stoppers 28232. Since the first stoppers 28231 and the second stoppers 28232 have the same angle of slope, the first stoppers 28231 are longer than the second stoppers 28232 and protrude higher than the second stoppers 28232, on the inner periphery of the coupler body 282.

The guide member 283 is disposed on the upper end of the coupler body 282. Opposite ends of the guide member 283 may protrude into the coupler body 282, thus allowing the coupler 28 to sit in locking grooves 29224 of the coupler guide 29.

The guide member 283 has the shape of a semi-circle and comprises a perimeter mounting portion 2831 mounted on the outer perimeter of the coupler body 282 and locking portions 2832*a* and 2832*b* that are bent toward the center of the coupler 282 from opposite ends of the perimeter mounting portion 2831 and protrude into the coupler body 282. The locking portions 2832*a* and 2832*b* of the guide member 283 may sit in the locking grooves 29224 of the coupler guide 29 when the coupler 28 moves upward, thus fixing the position of the coupler 28 spaced apart from the coupling flange 21232.

The perimeter mounting portion 2831 may have the shape of a semi-ring and be fixedly disposed on the outer perimeter of the coupler body 282. A guide member groove 2825 where the perimeter mounting portion 2831 is mounted is formed on the outer perimeter of the coupler 28.

The locking portions 2832*a* and 2832*b* of the guide member 283 may move along guide holes 294 between a plurality of guide projections 292 disposed on the coupler guide 29 or sit in the locking grooves 29224 of the coupler guide 29.

The locking portions 2832*a* and 2832*b* are disposed above the first stoppers 28231. The locking portions 2832*a* and 2832*b* are disposed above the first stoppers 28231, more adjacent to the lower ends of the first stoppers 28231 than to the upper ends of the first stoppers 28231.

The coupler body 282 comprises torque transmitting portions 2824*a* and 2824*b* disposed on the lower ends of the outer periphery of the coupler body 282, for receiving torque from the drive motor 21 when in contact with the drive motor 21.

The torque transmitting portions 2824*a* and 2824*b* may have a plurality of axial coupling teeth 2824*a* and axial coupling grooves 2824*b* that engage the plurality of tooth grooves 21232*c* and teeth 21232*d* of the coupling flange 21232. When the coupler body 282 is axially coupled to the coupling flange 21232, the plurality of axial coupling teeth 2824*a* and axial coupling grooves 2824*b* of the coupler body 282 mesh with the tooth grooves 21232*c* and teeth 21232*d* of the coupling flange 21232. When the coupler body 282 is axially decoupled from the coupling flange 21232, the plurality of axial coupling teeth 2824*a* and axial coupling grooves 2824*b* of the coupler body 282 are spaced a certain distance apart from the tooth grooves 21232*c* and teeth 21232*d* of the coupling flange 21232. The coupler body 282 is axially coupled to the coupling flange 21232 when the guide member 283 is disposed under the guide projections 292, and is axially decoupled from the coupling flange 21232 when the guide member 283 is locked in the locking grooves 29224 of the guide projections 292 and fixed in place.

Coupler Guide

The coupler guide 29 is rotatably disposed above the dewatering shaft 25 to keep the coupler 28 axially decoupled. The coupler guide 29 is disposed above the spline structure of the lower dewatering shaft 251. The coupler guide 29 is rotatably disposed at approximately a certain height from the dewatering shaft 25.

The upward and downward movement of the coupler guide 29 is restrained by the fixed ring 293 disposed under it and the dewatering shaft bearing 261 disposed over it. The coupler guide 29 rotates when in contact with the guide member 283 or stoppers 2823 of the coupler 28.

The coupler guide 29 comprises a coupler guide body 291 having the shape of a ring and disposed on the outer perimeter of the dewatering shaft 25, and a plurality of guide projections 292 disposed on the outer perimeter of the coupler guide body 291, that rotate the coupler guide body 291 or fix the position of the coupler 28, when in contact with the coupler 28.

The guide projections 292 may come into contact with the stoppers 2823 and restrain the upward movement of the coupler 28, or may come into contact with the guide member 283 to fix the coupler 28 in position once moved upward along the dewatering shaft 25.

The guide projections 292 each comprise a first locking ridge 292*a* for guiding the locking portions 2832*a* and 2832*b* positioned above it to the locking grooves 29224 and a second locking ridge 292*b* for guiding the locking portions 2832*a* and 2832*b* positioned above it to the guide holes 294.

When the locking portions 2832*a* and 2832*b* moved upward through the guide holes 294 move up the first locking ridges 292*a* by the rotation of the coupler guide 29, the first locking ridges 292*a* guide the downward-moving locking portions 2832*a* and 2832*b* to the locking grooves 29224. At this point, the locking portions 2832*a* and 2832*b* are locked in the locking grooves 29224, so that the coupler 28 is restrained from moving downward and disposed above the coupling flange 21232.

When the locking portions 2832*a* and 2832*b* moved upward through the guide holes 294 move up the second locking ridges 292*b* by the rotation of the coupler guide 29, the second locking ridges 292*b* guide the downward-moving locking portions 2832*a* and 2832*b* to the guide holes 294. At this point, the locking portions 2832*a* and 2832*b* pass through the guide holes 294 and move down the coupler guide 29, and the coupler 28 is disposed to engage the coupling flange 21232.

The guide projections 292 comprise a plurality of guide projections 292 spaced at regular intervals along the outer perimeter of the coupler guide body 291. Guide holes 294 through which the guide member 283 move are formed between the plurality of guide projections 292. The guide holes 294 are formed between first linear guide portions 2923 and second linear guide portions 2924 of the guide projections 292.

The guide projections 292 each comprise a lower surface guide portion 2921 that comes into contact with the stopper 2823 to restrain the upward movement of the coupler 28, an upper surface guide portion 2922 that comes into contact with the guide member 283 to adjust the position of the coupler 28, a first linear guide portion 2923 whose lower end makes contact with the stopper 2823, that connects one end of the lower surface guide portion 2921 and one end of the upper surface guide portion 2922, and a second linear guide portion 2924 which is shorter in length than the first linear guide portion 2923, that connects the other end of the lower surface guide portion 2921 and the other end of the upper surface guide portion 2922.

The lower surface guide portion 2921 has a sloping surface corresponding to the stopper 2823. The stopper 2823 comes into contact with the lower surface guide portion 2921 and moves upward, and is stopped from moving by means of the first linear guide portion 2923, thus restraining the upward movement of the coupler 28.

When the coupler 28 moves upward, the lower surface guide portion 2921 comes into contact with the stopper 2823 to rotate the coupler guide 29. Accordingly, the contact surface of the coupler guide 29 with which the guide member 283 makes contact changes when the coupler 28 moves upward.

The upper surface guide portion 2922 comprises two sloping surfaces which slope in the opposite direction to the lower surface guide portion 2921. The upper surface guide portion 2922 comprises a first sloping surface 29221 which slopes toward the lower surface guide portion 2921 from the first linear guide portion 2923, a connecting linear portion 29223 which is curved upward at an end of the first sloping surface 29221 and extends vertically, and a second sloping surface 29222 which slopes downward from the upper end of the connecting linear portion 29223.

The guide member 283 moves by contact with the first sloping surface 29221 or the second sloping surface 29222, and may be fixed in place between the first sloping surface 29221 and the connecting linear portion 29223. When the guide member 283 moves along the first sloping surface 29221, the movement of the guide member 283 between the first sloping surface 29221 and the connecting linear portion 29223 is restrained. When the guide member 283 moves along the second sloping surface 29222, the guide member 283 penetrates through the guide hole 294 and moves downward.

The angle of slope the first sloping surface 29221 forms with a virtual horizontal line (hereinafter, "the angle of slope of the first sloping surface") is greater than the angle of slope the second sloping surface 29222 forms with a virtual horizontal line (hereinafter, "the angle of slope of the second sloping surface"). Accordingly, the second linear guide portion 2924 is formed between an end of the second sloping surface 29222 and an end of the lower surface guide portion 2921.

The length 2924L to which the second linear guide portion 2924 extends vertically is smaller than the length 2923L to which the first linear guide portion 2923 extends vertically. The length 2924L of the second linear guide portion 2924 may be approximately equal to the length 294L of the guide hole 294. The length 2924L of the second linear guide portion 2924 is 90% to 110% of the distance 294L between the first linear guide portion 2923 and the second linear guide portion 2924 disposed adjacent to first linear guide portion 2923. The length 2924L of the second linear guide portion 2924 is greater than the diameter of the locking portions 2932*a* and 2932*b*.

The second linear guide portion 2924 may prevent the coupler guide 29 from rotating backward due to an impact caused when the guide member 283 moving along the lower surface guide portion 2921 comes into contact with the first linear guide portion 2923.

Operation Mode and Configuration of Coupler Depending on Mode Changes

A washing machine according to the present disclosure may operate in a first mode M1 in which the drive shaft 22 and the dewatering shaft 25 are axially coupled and both the drive shaft 22 and the dewatering shaft 25 are axially decoupled when the drive motor 21 rotates, and in a second mode M2 in which the drive shaft 22 and the dewatering shaft 25 are axially decoupled and the drive shaft 22 rotates along with the rotation of the drive motor 21.

In the first mode M1, the coupler 28 is in a first position P1 in which the torque transmitting portions 2824*a* and 2824*b* engage the plurality of teeth 21232*d* and tooth grooves 21232*c* of the coupling flange 21232. The drive shaft 22 and the dewatering shaft 25 are axially coupled when the coupler 28 is in the first position P1. When the coupler 28 is in the first position P1, the coupler 28 transmits the torque of the drive motor 21 to the dewatering shaft 25. When the coupler 28 is in the first position P1, the torque transmitting portions 2824*a* and 2824*b* engage the plurality of teeth 21232*d* and tooth grooves 21232*c* of the coupling flange 21232.

When the coupler 28 is in the first position P1, the guide member 283 is disposed under the coupler guide 29. When the coupler 28 is in the first position P1, the coupler 28 is fixed in place at the longitudinal lower end of the dewatering shaft 25 by gravity.

In the second mode M2, the coupler 28 is in a second position P2 in which the locking portions 2832*a* and 2832*b* of the guide member 283 are disposed on the upper sides of the locking grooves 29224 of the guide projections. When the coupler 28 is in the second position P2, the drive shaft 22 and the dewatering shaft 25 are axially decoupled. When the coupler 28 is in the second position P2, the coupler 28 does not transmit the torque of the drive motor 21 to the dewatering shaft 25. When the coupler 28 is in the second position P2, the torque transmitting portion 2824*a* and 2824*b* of the coupler 28 are placed at a distance above the coupling flange 21232.

When the coupler 28 is in the second position P2, the guide member 283 is disposed on the upper sides of the locking grooves 29224 of the coupler guide 29. When the coupler 28 is in the second position P2, the vertical position of the coupler 28 is fixed in a lengthwise direction of the dewatering shaft 25, above the coupler guide 29.

Referring to FIGS. 14A to 15D, the positional movement of the coupler 28 caused by the operation of the solenoid module 27 will be described. FIGS. 14A to 15D illustrate a plan view of guide projections 292*a* and 292*b*, locking portions 2832*a* and 2832*b*, first stoppers 28231*x*, 28231*y*, and 28231*z*, and second stoppers 28232*x*, 28232*y*, and 28232*z* disposed on an actual cylindrical coupler guide 29 and coupler 28, for convenience of explanation. The guide projections 292*a* and 292*b*, first stoppers 28231*x*, 28231*y*, and 28231*z*, and second stoppers 28232*x*, 28232*y*, and 28232*z* illustrated in FIGS. 14A to 15D are identical to the guide projections 292*a* and 292*b*, first stoppers 28231*x*, 28231*y*, and 28231*z*, and second stoppers 28232*x*, 28232*y*, and 28232*z* explained with reference to FIGS. 7 to 13B, although they may differ in identification number for ease of explanation.

First of all, referring to FIGS. 14A to 14D, a process in which the coupler 28 changes from the first mode M1 to the second mode M2 by the operation of the solenoid module 27 will be described. That is, a process in which the coupler 28 moves the dewatering shaft 25 and the drive shaft 22 from an axially coupled position to an axially decoupled position by the operation of the solenoid module 27 will be described. This may be a first mode change step subsequent to a mode resetting step, in a control method for the washing machine to be described below.

Figure 14A:
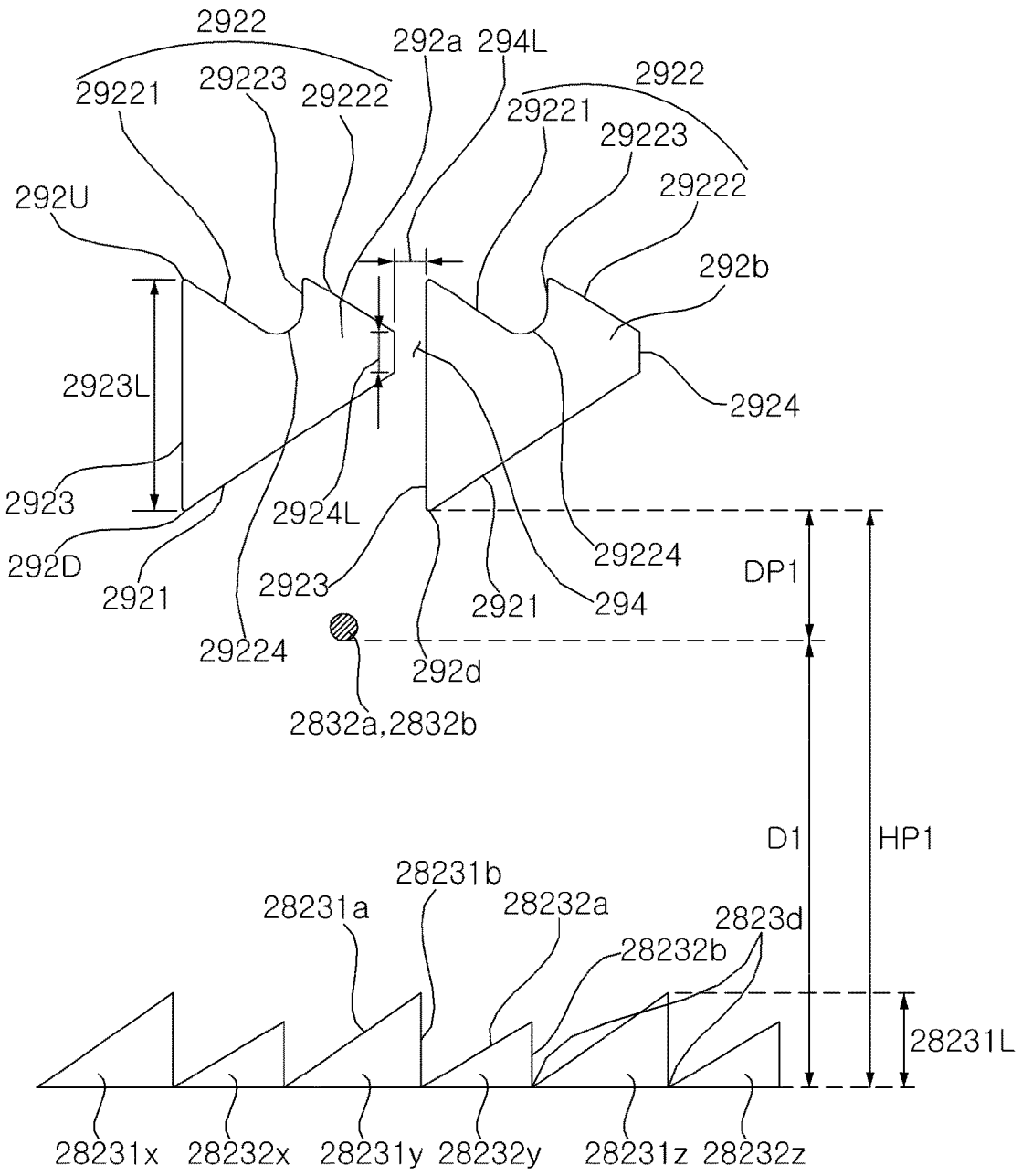
FIGS. 14A to 14D are views for explaining the relationship among stoppers of a coupler, a guide member of the coupler, and guide projections of a coupler guide, from a position where the coupler engages a coupling flange to a position where the coupler is fixed to the upper side of the coupler guide, according to an exemplary embodiment of the present disclosure.

FIG. 14A illustrates how the stoppers 28231*x*, 28232*x*, 28231*y*, 28232*y*, 28231*z*, and 28232*z*, the guide member 283, and the guide projections 292*a* and 292*b* are disposed while the coupler 28 is in the first position P1.

The stoppers and the locking portions 2832*a* and 2832*b* of the guide member are fixedly disposed on the coupler 28. Thus, the distance D1 between the lower ends 2823*d* of the stoppers, which are positioned between the first stoppers 28231*x*, 28231*y*, and 28231*z* and the second stoppers 28232*x*, 28232*y*, and 28232*z*, and the locking portions 2832*a* and 2832*b* is kept constant.

While the coupler 28 is in the first position P1, the distance HP1 between the lower ends 2823*d* of the stoppers and the lower ends 292D of the guide projections 292*a* and 292*b* is longer than the distance D1 between the lower ends 2823*d* of the stoppers and the locking portions 2832*a* and 2832*b*.

While the coupler 28 is in the first position P, the distance DP1 between the lower ends 292D of the guide projections 292*a* and 292*b* and the locking portions 2832*a* and 2832*b* is larger than the vertical length 28231L of the first stoppers 28231*x*, 28231*y*, and 28231*z*.

Figure 14B:
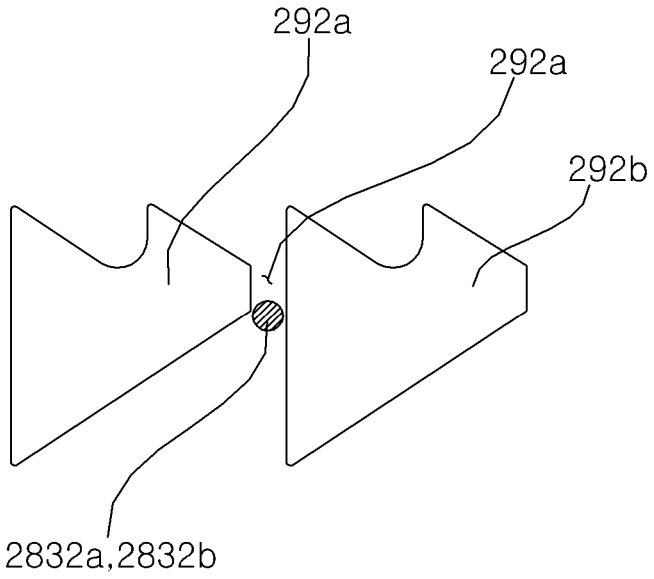
Figure 14B:
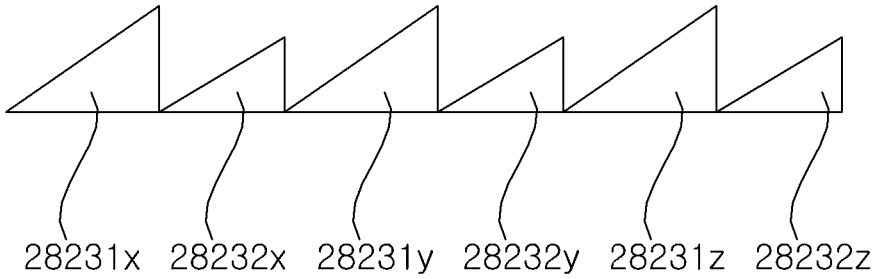
Figure 14C:
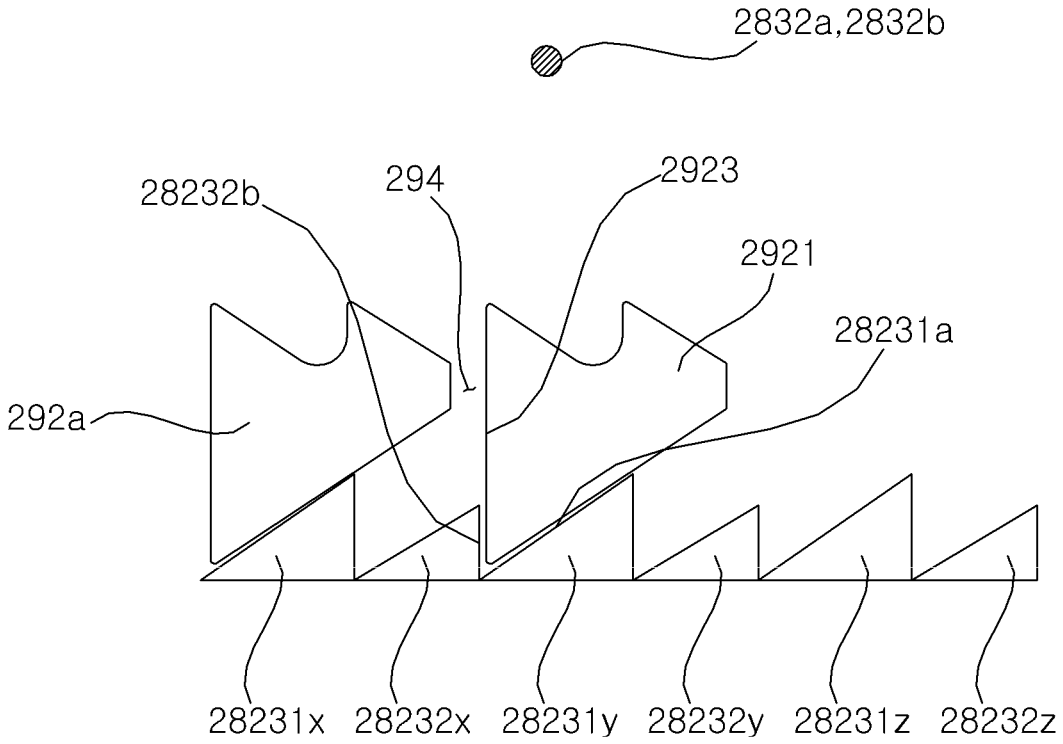
Figure 14D:
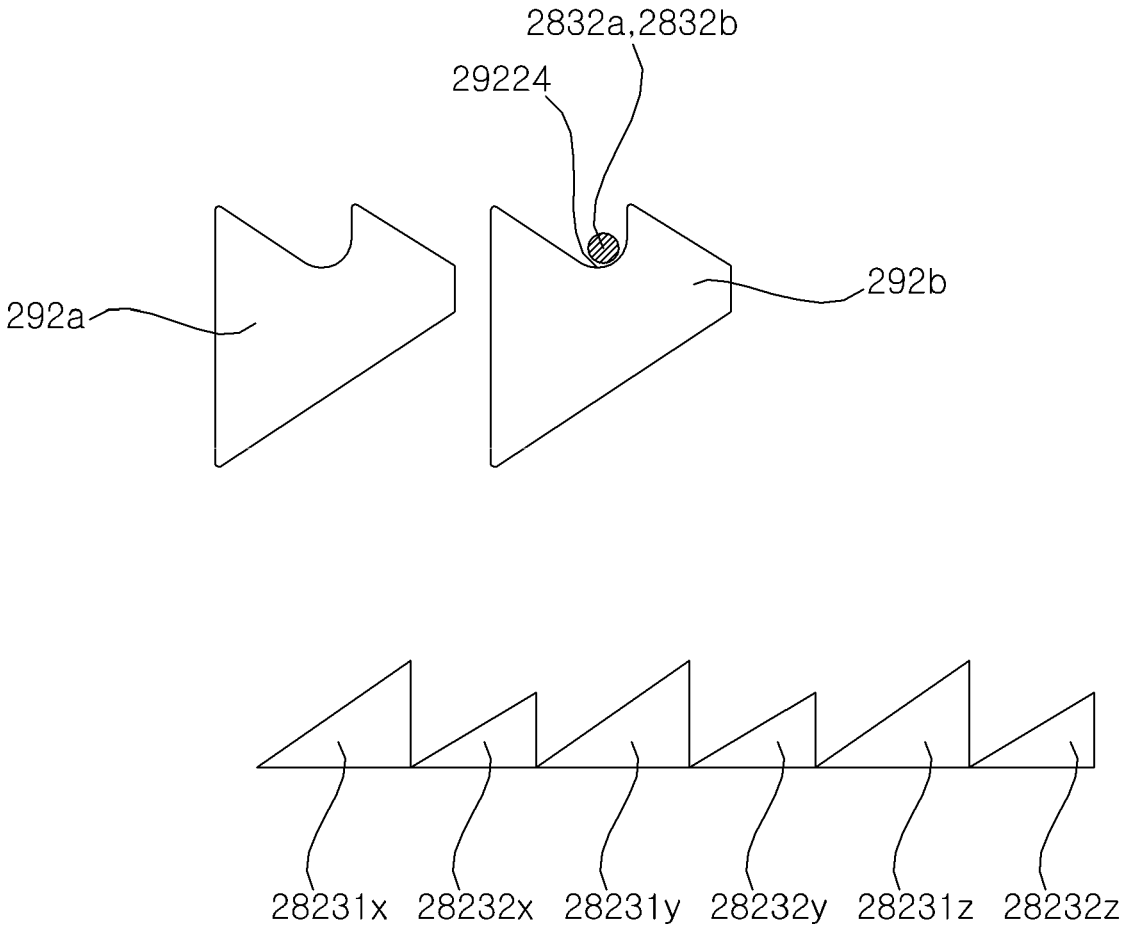

The solenoid module 27 moves the coupler 28 upward when an electric current is applied to the coil 2712 of the solenoid 271. In FIGS. 14A to 14C, the solenoid module 27 pulls the coupler 28 upward. Therefore, in FIGS. 14A to 14C, an electric current is applied to the coil 2712 of the solenoid 271, so that the locking portions 2832*a* and 2832*b* of the guide member 283 move upward.

In FIGS. 14A to 14C, when the locking portions 2832*a* and 2832*b* move upward, the locking portions 2832*a* and 2832*b* come into contact with the lower surface guide portions 2921 and move upward along the guide holes 294. Referring to FIGS. 14A to 14C, the locking portions 2832*a* and 2832*b* move upward until the first stoppers 28231*x*, 28231*y*, and 28231*z* engage the lower surface guide portion 2921. As shown in FIG. 14C, it can be seen that the coupler 28 is in a third position P3, while the first stoppers 28231*x*, 28231*y*, and 28231*z* are in contact with the lower surface guide portion 2921.

The third position P3 of the coupler 28 involves that the coupler guide 29 is rotated as the first stoppers 28231*x*, 28231*y*, and 28231*z* or the second stoppers 28232*x*, 28232*y*, and 28232*z* come into contact with the lower surface guide portions 2921 of the guide projections 292*a* and 292*b*. Accordingly, as shown in FIG. 14B, the third position P3 of the coupler 28 may comprise the best position where the coupler 28 can move upward as the first stoppers 28231*x*, 28231*y*, and 28231*z* or the second stoppers 28232*x*, 28232*y*, and 28232*z* come into contact the lower surface guide portions 2921 of the guide projections 292*a* and 292*b* over a large area. By the way, when the coupler 28 is in a (3-0)th position P3-0, this means that the coupler guide 29 is not rotated since the first stoppers 28231*x*, 28231*y*, and 28231*z* or the second stoppers 28232*x*, 28232*y*, and 28232*z* come into initial contact with the lower surface guide portions 2921 of the guide projections 292*a* and 292*b* as the coupler 28 moves upward. The (3-0)th position P3-0 is not included in the third position P3.

In FIGS. 14A to 14C, when the locking portions 2832*a* and 2832*b* move upward, they come into contact with the guide projections 292*a* and 292*b* to rotate the coupler guide 29 forward. The coupler guide 29 rotates in one direction when in contact with the guide member 283 of the coupler 28 or the stoppers 28231*x*, 28232*x*, 28231*y*, 28232*y*, 28231*y*, and 28232*z*, which is called forward rotation. Rotation in the opposite direction to the forward rotation is defined as the backward rotation of the coupler guide 29.

The locking portions 2832*a* and 2832*b* move upward by contact with the lower surface guide portions 2921 to rotate the coupler guide 29 forward. When the locking portions 2832*a* and 2832*b* move upward, the locking portions 2832*a* and 2832*b* move upward along the sloping surface of the lower surface guide portions 2921, so that the coupler guide 29 rotates forward. The coupler guide 29 rotates forward until the locking portions 2832*a* and 2832*b* come into contact with the upper ends of the lower surface guide portions 2921.

The locking portions 2832*a* and 2832*b* move upward along the guide holes 294.

When the locking portions 2832*a* and 2832*b* move upward along the guide holes 294, the locking portions 2832*a* and 2832*b* come into contact with the first linear guide portions 2923 of the guide projections 292*a* and 292*b* by means of the rotating coupler guide 29, so that the coupler guide 29 rotates backward. Incidentally, the backward rotation of the coupler guide 29 may be prevented by the second linear guide portions 2924 which are formed upward over a certain length on the upper ends of the lower surface guide portions 2921.

To prevent the backward rotation of the coupler guide 29, the vertical length 2924L of the second linear guide portions 2924L may be equal to or greater than the length 294L of the guide holes 294. To prevent the backward rotation of the coupler guide 29, the vertical length 2924L of the second linear guide portions 2924 may be greater than the cross-section diameter of the locking portions 2832*a* and 2832*b*.

Since the second linear guide portions 2924 have a certain length, the guide member 283, moved by the coupler guide 29 rotating backward, comes into contact with the second linear guide portions 2924, thereby preventing the backward rotation of the coupler guide 29.

When the locking portions 2832*a* and 2832*b* move upward through the guide holes 294, the first stoppers 28231*x*, 28231*y*, and 28231*z* of the coupler 28 come into contact with the lower surface guide portions 2921. The locking portions 2832*a* and 2832*b* are disposed above the first stoppers 28231$x$, 28231$y$, and 28231$z$. The locking portions 2832$a$ and 2832$b$ are disposed above the first stoppers 28231$x$, 28231$y$, and 28231$z$, adjacent to the lower ends of the first stoppers 28231$x$, 28231$y$, and 28231$z$. That is, the locking portions 2832$a$ and 2832$b$ are disposed above the first stoppers 28231$x$, 28231$y$, and 28231$z$, much closer to the lower ends of the first stoppers 28231$x$, 28231$y$, and 28231$z$ relative to the center of the first stoppers 28231$x$, 28231$y$, and 28231$z$.

With this structure, when the locking portions 2832$a$ and 2832$b$, once passed through the guide holes 294, move upward, the coupler guide 29 may be stopped from moving, or, even if it partially rotates backward, the first stoppers 28231$x$, 28231$y$, and 28231$z$ and the lower surface guide portions 2921 may make contact with each other.

When the locking portions 2832$a$ and 2832$b$ move upward, the first stopper sloping surfaces 28231$a$ of the first stoppers 28231$x$, 28231$y$, and 28231$z$ and the sloping surfaces of the lower surface guide portions 2921 make contact with each other, allowing the coupler guide 29 to rotate forward. The coupler guide 29 rotates forward until the first linear guide portions 2923 of the guide projections 292$a$ and 292$b$ come into contact with the second stopper vertical surfaces 28232$b$ of the second stoppers 28232$x$, 28232$y$, and 28232$z$. The locking portions 2832$a$ and 2832$b$ move upward until the first linear guide portions 2923 of the guide projections 292$a$ and 292$b$ come into contact with the second stopper vertical surfaces 28232$b$ of the second stoppers 28232$x$, 28232$y$, and 28232$z$.

Once the locking portions 2832$a$ and 2832$b$ are moved upward until the first linear guide portions 2923 of the guide projections 292$a$ and 292$b$ come into contact with the second stopper vertical surfaces 28232$b$ of the second stoppers 28232$x$, 28232$y$, and 28232$z$, the locking portions 2832$a$ and 2832$b$ are disposed over the first slopping surfaces 29221 of the guide projections 292$a$ and 292$b$.

Accordingly, when the force of the solenoid module 27 applied to pull the coupler 28 upward is released, the coupler 28 moves downward by gravity, and the locking portions 2832$a$ and 2832$b$ move to the locking grooves 29224 of the upper surface guide portions 2922 of the guide projections 292$a$ and 292$b$. That is, the locking portions 2832$a$ and 2832$b$ move downward by contact with the first sloping surfaces 29221 of the upper surface guide portions 2922. At this point, the load of the locking portions 2832$a$ and 2832$b$ acting downward on the first sloping surfaces 29221 causes the coupler guide 29 to rotate forward. The coupler guide 29 rotates forward until the locking portions 2832$a$ and 2832$b$ are placed in the locking grooves 29224. When the locking portions 2832$a$ and 2832$b$ are positioned in the locking grooves 29224 of the guide projections 292$a$ and 292$b$, the position of the coupler 28 may be fixed. In this instance, even if there is no electric current applied to the solenoid module 27, the coupler 28 may be placed at a certain distance above the coupling flange 21232.

Hereinafter, referring to FIGS. 15A to 15D, a process in which the coupler 28 changes from the second mode M2 to the first mode M1 by the operation of the solenoid module 27 will be described. That is, a process in which the coupler 28 moves the dewatering shaft 25 and the drive shaft 22 from an axially coupled position to an axially decoupled position by the operation of the solenoid module 27 will be described. This may be a second mode change step which is carried out after the first mode change step, in a control method for the washing machine to be described below.

Figure 15A:
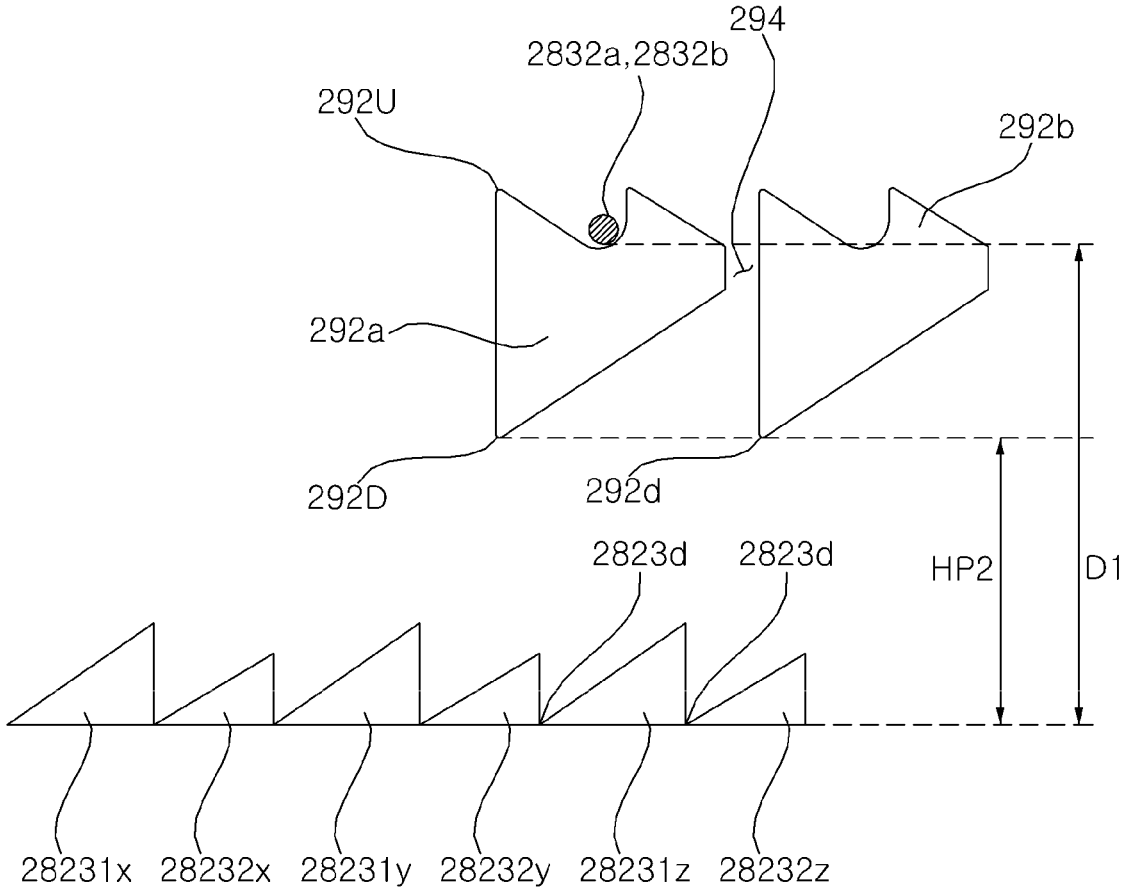
FIGS. 15A to 15D are views for explaining the relationship among stoppers of a coupler, a guide member of the coupler, and guide projections of a coupler guide, from a position where the coupler is fixed to the upper side of the coupler guide to a position where the coupler engages a coupling flange, according to an exemplary embodiment of the present disclosure.
Figure 15B:
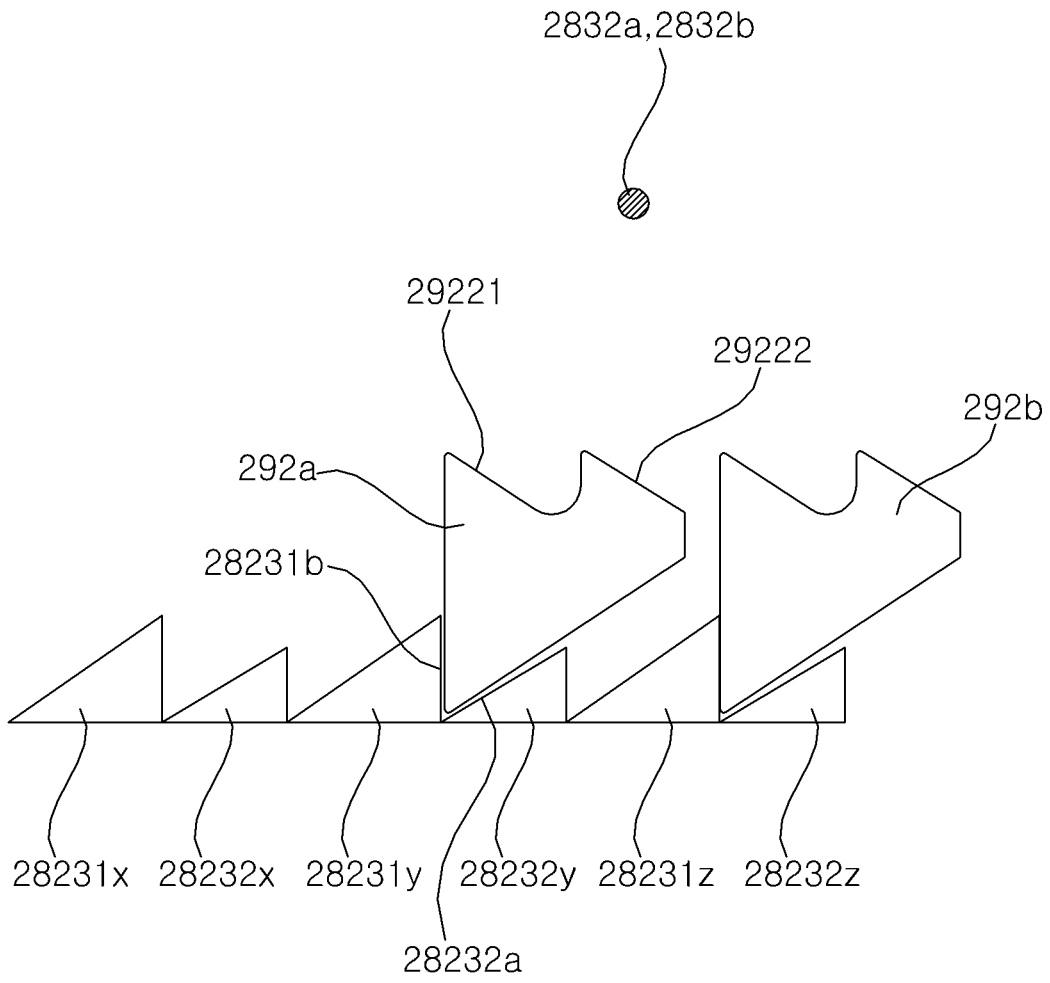
Figure 15C:
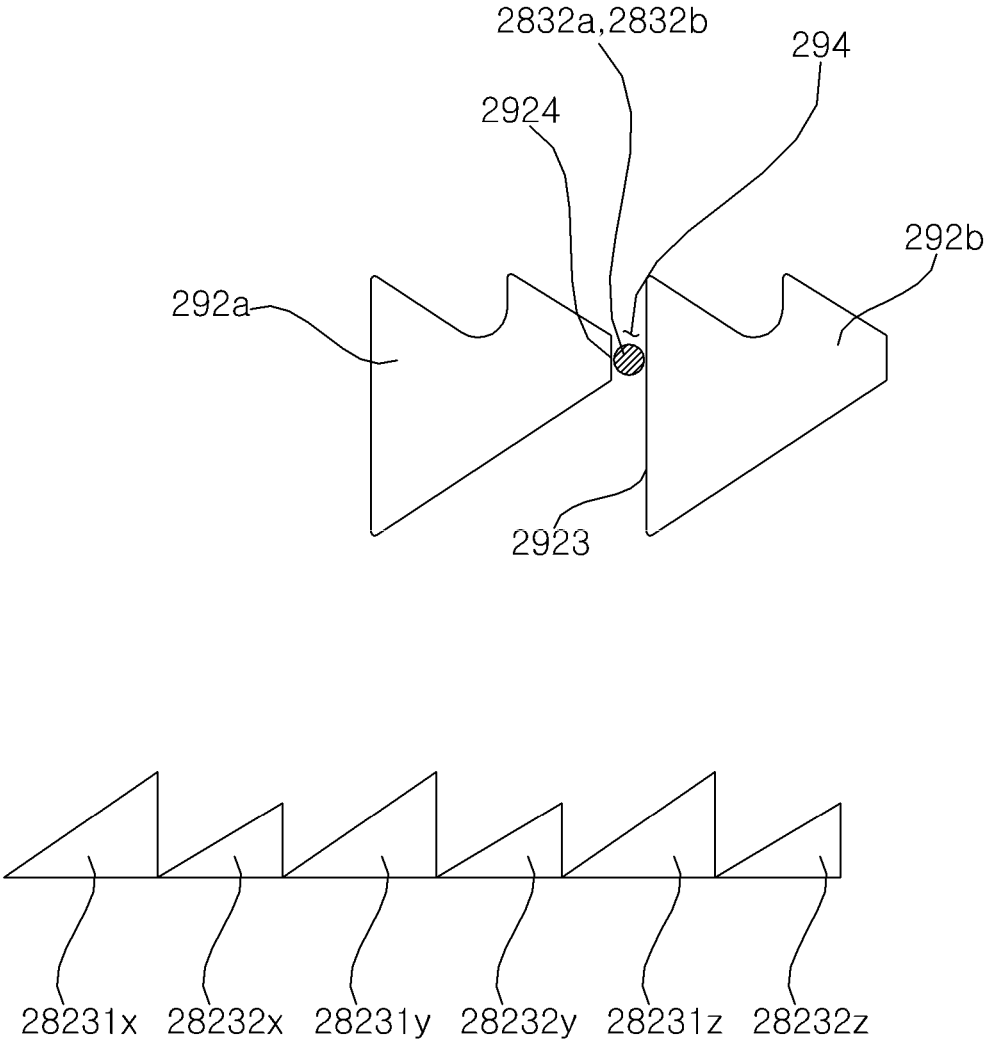
Figure 15D:
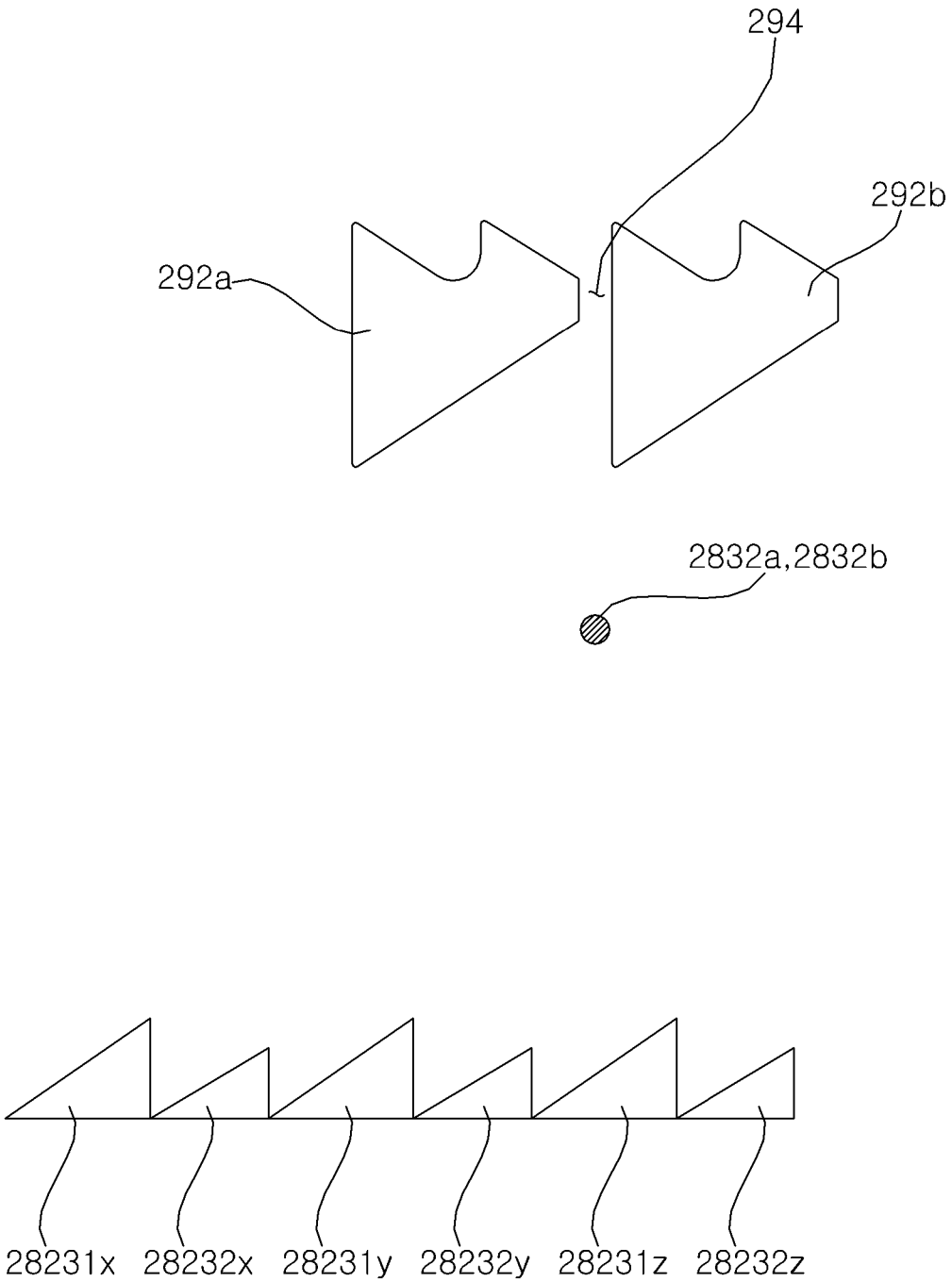

FIG. 15A illustrates how the stoppers 28231$x$, 28232$x$, 28231$y$, 28232$y$, 28231$z$, and 28232$z$, the guide member 283, and the guide projections 292$a$ and 292$b$ are disposed while the coupler 28 is in the second position P2.

While the coupler 28 is in the second position P2, the distance HP2 between the lower ends 2823$d$ of the stoppers and the lower ends 292D of the guide projections 292$a$ and 292$b$ is longer than the distance D1 between the lower ends 2823$d$ of the stoppers and the locking portions 2832$a$ and 2832$b$.

The solenoid module 27 moves the coupler 28 upward when an electric current is applied to the coil 2712 of the solenoid 271. In FIGS. 14A and 14B, the solenoid module 27 pulls the coupler 28 upward. Therefore, in FIGS. 14A and 14B, an electric current is applied to the coil 2712 of the solenoid 271, so that the locking portions 2832$a$ and 2832$b$ of the guide member 283 move upward.

The locking portions 2832$a$ and 2832$b$ move upward from the locking grooves 29224. When the locking portions 2832$a$ and 2832$b$ move upward, the second stopper sloping surfaces 28232$a$ of the second stoppers 28232$x$, 28232$y$, and 28232$z$ and the sloping surfaces of the lower surface guide portions 2921 make contact with each other, allowing the coupler guide 29 to rotate forward. The coupler guide 29 rotates forward until the first linear guide portions 2923 of the guide projections 292$a$ and 292$b$ come into contact with the first stopper vertical surfaces 28231$b$ of the first stoppers 28231$x$, 28231$y$, and 28231$z$. The locking portions 2832$a$ and 2832$b$ move upward until the first linear guide portions 2923 of the guide projections 292$a$ and 292$b$ come into contact with the first stopper vertical surfaces 28231$b$ of the first stoppers 28231$x$, 28231$y$, and 28231$z$.

Once the locking portions 2832$a$ and 2832$b$ are moved upward until the first linear guide portions 2923 of the guide projections 292$a$ and 292$b$ come into contact with the first stopper vertical surfaces 28231$b$ of the first stoppers 28231$x$, 28231$y$, and 28231$z$, the locking portions 2832$a$ and 2832$b$ are disposed over the second slopping surfaces 29222 of the guide projections 292$a$ and 292$b$.

When the force of the solenoid module 27 applied to pull the coupler 28 upward is released, the coupler 28 moves downward by gravity, and the locking portions 2832$a$ and 2832$b$ move to the guide holes 294 formed between the plurality of guide projections 292$a$ and 292$b$. That is, the locking portions 2832$a$ and 2832$b$ move downward by contact with the second sloping surfaces 29222 of the upper surface guide portions 2922. At this point, the load of the locking portions 2832$a$ and 2832$b$ acting downward on the second sloping surfaces 29222 causes the coupler guide 29 to rotate forward. The coupler guide 29 rotates forward until the locking portions 2832$a$ and 2832$b$ are moved to the guide holes 294.

As the locking portions 2832$a$ and 2832$b$ move to the lower side of the coupler guide 29 along the guide holes 294, the coupler 28 moves downward. The coupler 28 moves downward until it reaches the first position P1 of the coupler 28.

Along with the downward movement of the coupler 28, the torque transmitting portions 2824$a$ and 2824$b$ of the coupler 28 are disposed to engage the coupling flange 21232. At this point, the coupler 28 becomes capable of transmitting the torque of the drive motor 21 to the dewatering shaft 25.

Controller and Related Components

Figure 16:
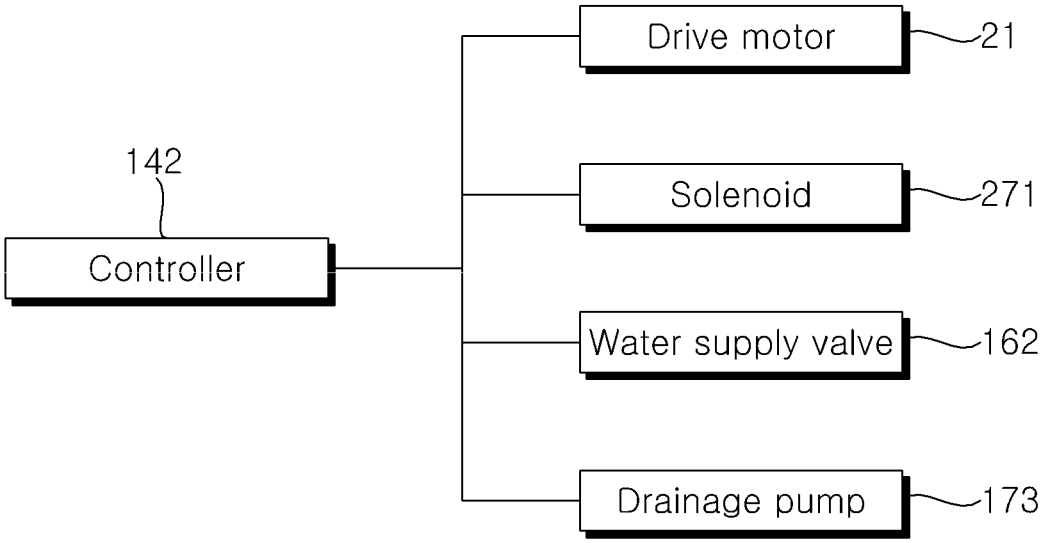
FIG. 16 is a block diagram illustrating a controller and its related components according to an exemplary embodiment of the present disclosure.
Figure 17:
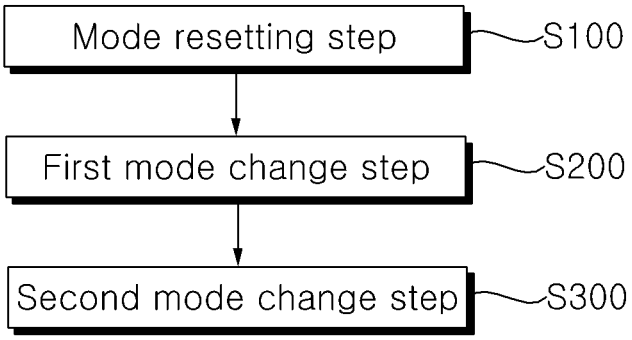
FIG. 17 is a sequential diagram illustrating a control method for a washing machine according to an exemplary embodiment of the present disclosure.
Figure 18:
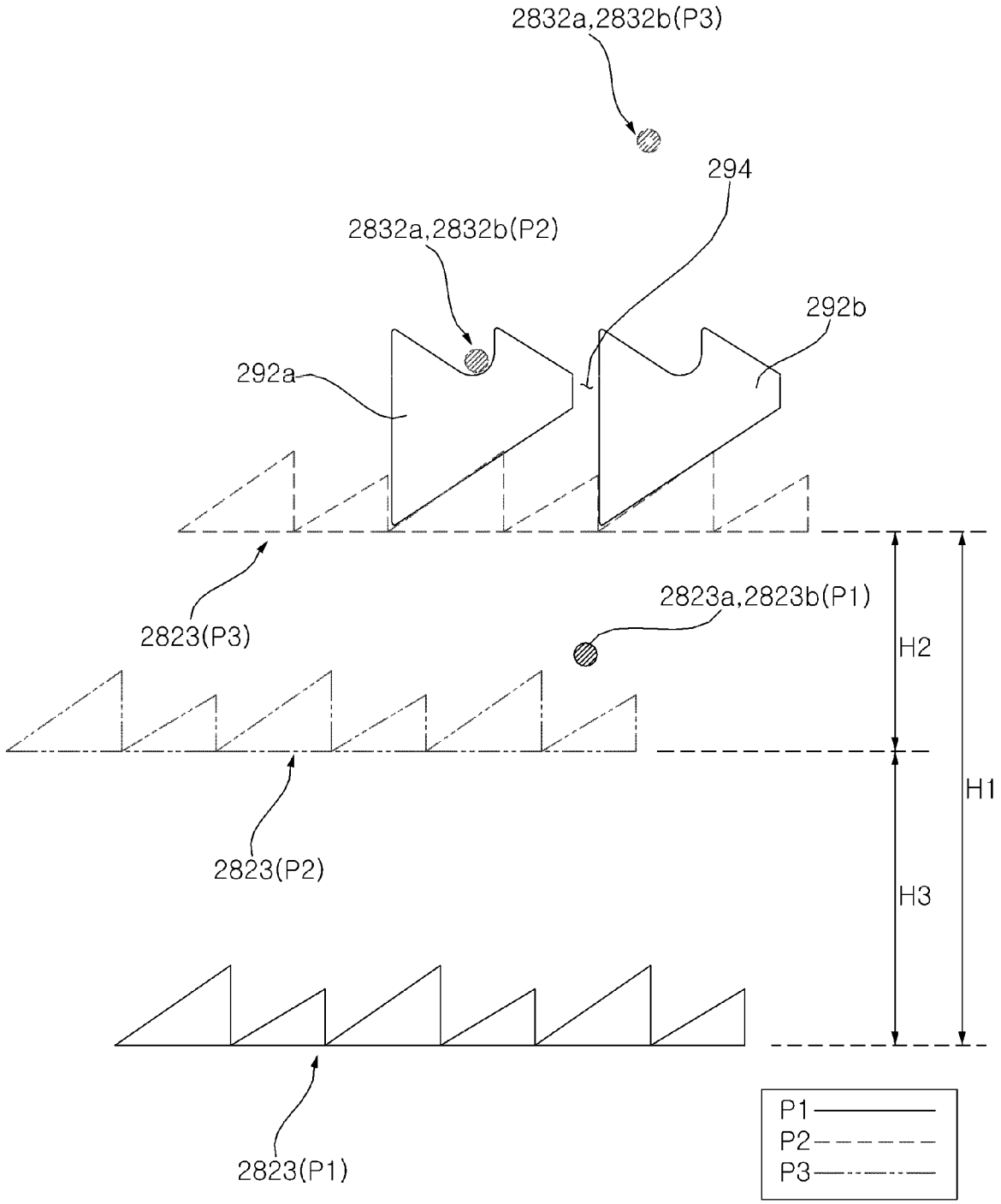
FIG. 18 is a view for explaining the configurations of guide projections and a coupler when the coupler is in a first position P1, a second position P2, and a third position P3, according to an exemplary embodiment of the present disclosure.

Hereinafter, a controller 142 for controlling the operation of a washing machine according to the present disclosure and its related components will be described with reference to FIG. 16.

The washing machine according to the present disclosure comprises a controller 142 that controls the drive motor 21 to make it rotate or to form a magnetic field in the solenoid module 27.

The controller 142 may allow the drive motor 21 to generate torque by applying an electric current to the drive motor 21. When the drive motor 21 rotates by means of the controller 142, the drive shaft 22 connected to the rotor bush 21231 rotates too. When the drive motor 21 rotates by means of the controller 142, the dewatering shaft 25 may be selectively rotated. When the drive motor 21 rotates, with the coupler 28 engaging the coupling flange 21232, the dewatering shaft 25 rotates together with the drive motor 21.

The controller 142 may operate the solenoid module 27 to move the coupler 28 from the first position P1 to the second position P2 or move the coupler 28 from the second position P2 to the first position P1. Also, the controller 142 may operate the solenoid module 27 to keep the coupler 28 in the first position P1 or move the coupler 28 from the second position P2 to the first position P1.

The controller 142 makes the solenoid module 27 operate to move the coupler 28 from the second position P2 to a position where the coupler 28 makes contact with the coupler guide 29 and move the coupler 28 from the first position P1 to a position where the coupler 28 does not make contact with the coupler guide 29.

The controller 142 makes the solenoid module 27 operate to move the coupler 28 within a range where the coupler guide 29 does not rotate when the locking portions 2832*a* and 2832*b* move up the dewatering shaft along the guide holes 294 and in a range where the coupler guide 29 rotates when the locking portions 2832*a* and 2832*b* move up the locking grooves 29224. Here, the range where the coupler guide 29 does not rotate refers to a range where the coupler guide 29 does not rotate by contact between the lower surface guide portions 2921 of the guide projections 292 and the stoppers 2823 of the coupler 28, which may mean the height up to which there is no contact between the lower surface guide portions 2921 of the guide projections 292 and the stoppers 2823 of the coupler 28. Also, the range where the coupler guide 29 rotates refers to a range where the coupler guide 29 rotates by contact between the lower surface guide portions 2921 of the guide projections 292 and the stoppers 2823 of the coupler 28. That is, within a range where the coupler guide 29 rotates, the coupler 28 moves upward while there is contact between the lower surface guide portions 2921 of the guide projections 292 and the stoppers 2823 of the coupler 28, thus causing the coupler guide 29 to rotate. Moreover, the controller 142 may regulate the water supply valve 162 or regulate the operation of the drainage pump 173.

Control Method

Hereinafter, a control method for a washing machine according to the present disclosure will be described with reference to FIGS. 12A to 18.

In the control method for the washing machine according to the present disclosure, a mode resetting step S100 is performed to adjust the configuration of the coupler 28 by the operation of the solenoid module 27 so that the coupler 28 in the first position P1 or second position P2 is kept in the first position P1 or moved to the first position P1. That is, the mode resetting step S100 is a step of adjusting the configuration of the coupler 28 to place it into the first mode M1. Afterwards, a first mode change step S200 is performed to move the coupler 28 from the first position P1 of the first mode M1 to the second position P2 of the second mode M2 by the operation of the solenoid module 27. Afterwards, a second mode change step S300 is performed to move the coupler 28 from the second position P2 of the second mode M2 to the first position P1 of the first mode M1 by the operation of the solenoid module 27.

In the mode resetting step S100, the coupler 28 is moved upward by applying an electric current to a coil of the solenoid 27, so that the coupler 28 in the first mode M1 or in the second mode M2 moves down the coupler guide 29 along the guide holes 294 formed in the coupler guide 29.

In the mode resetting step S100, the controller 142 makes the solenoid module 27 operate in such a way that the coupler 28 in the first position P1 moves as high as or less than the distance H3 between the first position P1 and the second position P2. In the mode resetting step S100, the controller 142 makes the solenoid module 27 operate in such a way that the coupler 28 in the first position P1 moves less than the distance H1 between the first position p1 and the third position P3. The controller 142 makes the solenoid module 27 operate in such a way that the coupler 28 in the second position P2 moves as high as or greater than the distance H2 between the second position P2 and the third position P3.

In the mode resetting step S100, the controller 142 operates the solenoid module 27 such that the coupler 28 moves within a range where there is no contact between the first stoppers 28231 and the lower surface guide portions 2921 of the guide projections 292 when the coupler in the first position P1 moves upward. In the mode resetting step S100, the controller 142 moves the coupler 28 by operating the solenoid module 27 within a range where the coupler guide 29 rotates by contact between the second stoppers 28232 and the lower surface guide portions 2921 of the guide projections 292 when the coupler 28 in the second position P2 moves upward.

Through the mode resetting step S100, the first mode M1 where the coupler 28 is in the first position P1 is maintained. Through the mode resetting step S100, the coupler 28 in the second position P2 changes from the second mode M2 to the first mode M1 to move to the first position P1.

Referring to FIGS. 13A and 13B and FIGS. 14A and 14B, the distance H1 of upward movement of the coupler 28 in the first mode change step in which the coupler 28 changes from the first mode M1 to the second mode M2 is greater than the distance H2 of upward movement of the coupler 28 in the second mode change step S300 in which the coupler 28 changes from the second mode M2 to the first mode M1.

Accordingly, there may be a difference between the time T1 taken to move the coupler 28 upward in the first mode change step S200 and the time T2 taken to move the coupler 28 upward in the second mode change step S300. That is, the time T1 taken to move the coupler 28 upward in the first mode change step S200 is longer than the time T2 taken to move the coupler 28 upward in the second mode change step S300.

In the mode resetting step S100, it takes a shorter time to operate the solenoid module 27 than the time T1 taken to move the coupler 28 upward in the first mode change step S200. In the mode resetting step S100, it takes the same amount of time or longer to operate the solenoid module 27 than the time T2 taken to move the coupler 28 upward in the second mode change step S300. Specifically, the time for electric current application to the coil 2712 of the solenoid 271 in the mode resetting step S100 is somewhere between the minimum time T1 for electric current application to the coil 2712 in the first mode change step S200 and the minimum time T2 for electric current application to the coil 2712 in the second mode change step S300.

Therefore, in the mode resetting step S100, the second mode change step S300 may be implemented, whereas the first mode change step S200 is not implemented.

Afterwards, the first mode change step S200 is performed to move the coupler in the first position P1 of the first mode M1 to the second position P2 of the second mode M2. This step is performed in the same manner as changing the configuration of the coupler 28 explained previously with reference to FIGS. 13A to 13D.

Next, the second mode change step S300 is performed to move the coupler in the second position P2 of the second mode M2 to the first position P1 of the first mode M1. This step is performed in the same manner as changing the configuration of the coupler 28 explained previously with reference to FIGS. 14A to 14D.

Exemplary embodiments of the present disclosure have been illustrated and described above, but the present disclosure is not limited to the above-described specific embodiments, it is obvious that various modifications may be made by those skilled in the art, to which the present disclosure pertains without departing from the gist of the present disclosure, which is claimed in the claims, and such modification should not be individually understood from the technical spirit or prospect of the present disclosure.

A washing machine of the present disclosure has one or more of the following advantages:

Firstly, the washing machine comprises a coupler guide that rotates itself or fixes the position of the coupler, when the coupler moves upward in the lengthwise direction of the dewatering shaft, whereby the coupler may be fixed in position by the solenoid module once moved upward. Specifically, with a structure in which the coupler moving up and down the dewatering shaft locks onto the coupler guide moving in a circumferential direction of the dewatering shaft, the coupler may be fixed in position by the solenoid module once moved upward. Due to this, the coupler may be fixed in position once moved upward, without continuous operation of the solenoid module, thereby reducing power consumption and solving the problem of heat generation from a coil. Moreover, the problem of abnormal operation of the solenoid module may be prevented.

Secondly, it is possible to figure out the configuration of the coupler by adjusting the distance the coupler moves by the solenoid module so that the configuration of the coupler is reset to the first position. This allows for figuring out the configuration of the coupler without a sensor during washing, which may lead to a reduction in material costs.

Thirdly, it is possible to figure out the configuration of the coupler by adjusting the operation time of the solenoid required to move the coupler so that the configuration of the coupler is reset to the first position. Therefore, the washing tub and pulsator can operate correctly when laundry washing is performed.

The advantageous effects of the present disclosure are not limited to the aforementioned ones, and other advantageous effects, which are not mentioned above, will be clearly understood by those skilled in the art from the claims.

What is claimed is:

1. A washing machine comprising:

a washing tub configured to receive laundry;

a pulsator rotatably disposed within the washing tub;

a dewatering shaft configured to rotate about an axis to thereby rotate the washing tub;

a drive shaft configured to rotate about the axis to thereby rotate the pulsator;

a coupler that is configured to move up and down along the dewatering shaft, the coupler being configured to be disposed at (i) a first position for coupling the drive shaft and the dewatering shaft to each other or (ii) a second position for decoupling the drive shaft and the dewatering shaft from each other, the second position being disposed vertically above the first position;

a solenoid module configured to move the coupler upward from the first position or the second position;

a coupler guide configured to be rotated by contacting the coupler based on the coupler moving upward and to maintain the coupler in the second position, the coupler guide being configured to guide the coupler to the first position based on the coupler moving downward; and a controller configured to control operation of the solenoid module, wherein the coupler comprises:

a coupler body configured to move up and down along the dewatering shaft, a guide member including locking protrusions that protrude from an inner periphery of the coupler body and that are configured to lock onto an upper side of the coupler guide, and one or more stoppers that define a sloping surface on the inner periphery of the coupler body and configured to contact the coupler guide to thereby restrict an upward movement of the coupler body, wherein the coupler guide is configured to be rotated in one direction by contacting the one or more stoppers, wherein the coupler guide comprises a plurality of guide projections that define locking grooves configured to catch the locking protrusions, the plurality of guide projections being spaced apart from one another to thereby define guide holes through which the locking protrusions pass, and wherein the controller is configured to, based on adjusting an operation time of the solenoid module, (i) maintain the coupler in the first position after moving the coupler to a non-contact position where the one or more stoppers are separated from the coupler guide or (ii) move the coupler from the second position to the first position through a contact position where the one or more stoppers are in contact with the coupler guide.

2. The washing machine of claim 1, wherein the controller is configured to operate the solenoid module to move the coupler by a distance that is less than or equal to a reference distance between the first position and the second position.

3. The washing machine of claim 1, wherein the guide member is configured to be disposed vertically below the coupler guide based on the coupler being disposed in the first position.

4. The washing machine of claim 1, wherein the guide member is configured to be disposed at an upper side of the locking groove based on the coupler being in the second position.

5. The washing machine of claim 1, wherein the coupler guide further comprises a coupler guide body that has a ring shape and is disposed at an outer perimeter of the dewatering shaft, wherein the plurality of guide projections are disposed on an outer surface of the coupler guide body and configured to, based on contacting the one or more stoppers, rotate the coupler guide body or maintain a position of the coupler, wherein the one or more stoppers include a plurality of stoppers that are disposed below the guide member and configured to, based on the coupler moving upward, come into contact with the plurality of guide projections and rotate the coupler guide, and wherein the controller is configured to operate the solenoid module to move the coupler to the second position in which the plurality of stoppers contact the plurality of guide projections.

6. The washing machine of claim 5, wherein the plurality of stoppers comprise:

first stoppers configured to come into contact with the plurality of guide projections based on the coupler moving upward from the first position; and second stoppers configured to come into contact with the plurality of guide projections based on the coupler moving upward from the first position.

7. The washing machine of claim 6, wherein the controller is configured to operate the solenoid module to move the coupler to the first position in which the first stoppers are spaced apart from the plurality of guide projections.

8. The washing machine of claim 6, wherein the controller is configured to operate the solenoid module to move the coupler to the second position, the coupler guide being configured to, based on the coupler moving to the second position, be rotated by contact between the second stoppers and the plurality of guide projections.

9. A washing machine comprising:

a water tank;

a washing tub rotatably disposed in the water tank and configured to receive laundry;

a pulsator rotatably disposed within the washing tub;

a drive motor configured to generate torque for rotating the washing tub or the pulsator;

a coupling flange connected to the drive motor and configured to rotate together with the drive motor;

a drive shaft configured to rotate about an axis based on the torque of the drive motor to thereby rotate the pulsator;

a dewatering shaft configured to rotate about the axis of the drive shaft to thereby rotate the washing tub;

a coupler configured to move up and down along the dewatering shaft, the coupler being configured to be disposed at (i) a first position for coupling the drive shaft and the dewatering shaft to each other at a position vertically above the coupling flange or (ii) a second position for engaging the coupler with the coupling flange;

a solenoid module configured to move the coupler upward from the first position or the second position;

a coupler guide configured to, based on the coupler moving upward, be rotated by the coupler by contacting the coupler, and configured to couple to the coupler in the first position; and a controller configured to control operation of the solenoid module, wherein the coupler comprises:

a coupler body configured to move up and down along the dewatering shaft, the coupler body being configured to receive the torque from the drive motor, a guide member including locking protrusions that protrude from an inner periphery of the coupler body and that are configured to lock onto an upper side of the coupler guide, and one or more stoppers that define a sloping surface on the inner periphery of the coupler body and are configured to contact the coupler guide to thereby restrict an upward movement of the coupler body, wherein the coupler guide is configured to be rotated in one direction by contacting the one or more stoppers, wherein the coupler guide comprises a plurality of guide projections that define locking grooves configured to catch the locking protrusions, the plurality of guide projections being spaced apart from one another to thereby define guide holes through which the locking protrusions pass, and wherein the controller is configured to:

move the coupler from the first position to a contact position where the one or more stoppers are in contact with the coupler guide, and move the coupler from the second position to a non-contact position where the one or more stoppers are separated from the coupler guide.

* * * * *